US009595751B2

(12) United States Patent
Enomoto

(10) Patent No.: US 9,595,751 B2
(45) Date of Patent: Mar. 14, 2017

(54) ELECTRONIC DEVICE

(71) Applicant: Sony Corporation, Tokyo (JP)

(72) Inventor: Takashi Enomoto, Nagano (JP)

(73) Assignee: SONY CORPORATION, Tokyo (JP)

( * ) Notice: Subject to any disclaimer, the term of this patent is extended or adjusted under 35 U.S.C. 154(b) by 197 days.

(21) Appl. No.: 14/357,021

(22) PCT Filed: Oct. 19, 2012

(86) PCT No.: PCT/JP2012/077053

§ 371 (c)(1),
(2) Date: May 8, 2014

(87) PCT Pub. No.: WO2013/073334

PCT Pub. Date: May 23, 2013

(65) Prior Publication Data

US 2014/0306850 A1 Oct. 16, 2014

(30) Foreign Application Priority Data

Nov. 17, 2011 (JP) ..... 2011-251696

(51) Int. Cl.

| | |
|---|---|
| ***H01Q 1/22*** | (2006.01) |
| ***H01Q 5/00*** | (2015.01) |
| ***H01Q 9/30*** | (2006.01) |
| ***H01Q 1/24*** | (2006.01) |
| ***H01Q 9/36*** | (2006.01) |
| ***H01Q 5/378*** | (2015.01) |

(52) U.S. Cl.

CPC ..... *H01Q 1/24* (2013.01); *H01Q 1/2266* (2013.01); *H01Q 5/378* (2015.01); *H01Q 9/36* (2013.01)

(58) Field of Classification Search

CPC ..... H01Q 1/2266; H01Q 1/2291; H01Q 1/24; H01Q 1/241; H01Q 1/243; H01Q 5/378; H01Q 5/385; H01Q 5/392; H01Q 1/2258; H01Q 1/245; H01Q 5/30; H01Q 5/307; H01Q 9/42; H01Q 9/30; H01Q 1/2275

See application file for complete search history.

(56) References Cited

U.S. PATENT DOCUMENTS 6,806,834 B2 10/2004 Yoon
6,985,108 B2 * 1/2006 Mikkola ..... H01Q 1/243 343/700 MS (Continued)

FOREIGN PATENT DOCUMENTS

JP 2001-085920 A 3/2001
JP 2003-318640 A 11/2003

(Continued)

OTHER PUBLICATIONS

International Search Report dated Dec. 18, 2012.

*Primary Examiner* — Sue A Purvis
*Assistant Examiner* — Patrick Holecek
(74) *Attorney, Agent, or Firm* — Chip Law Group

(57) ABSTRACT

Provided is an electronic device including a case including a conductor part, and an antenna that is provided on a case surface on an inner side of the conductor part and includes an antenna element extending in a first direction parallel to the case surface, the antenna element being grounded to the case surface. A slit extending in the first direction is formed in an area of the case surface, the area being parallel to the antenna element.

10 Claims, 34 Drawing Sheets

(56) References Cited

U.S. PATENT DOCUMENTS

| | | | | |
|---|---|---|---|---|
| 7,612,725 | B2 | 11/2009 | Hill et al. | |
| 7,683,840 | B2 * | 3/2010 | Lin | H01Q 1/243 343/702 |
| 7,768,462 | B2 * | 8/2010 | Zhang | H01Q 1/243 343/702 |
| 7,843,396 | B2 | 11/2010 | Hill et al. | |
| 7,872,605 | B2 * | 1/2011 | Baliarda | H01Q 9/0421 343/700 MS |
| 7,924,231 | B2 | 4/2011 | Hill et al. | |
| 8,106,836 | B2 * | 1/2012 | Hill | H01Q 1/243 343/700 MS |
| 8,432,321 | B2 * | 4/2013 | Arkko | H01Q 1/243 343/702 |
| 8,779,999 | B2 * | 7/2014 | Gummalla | G06F 1/1656 343/702 |
| 8,816,927 | B2 * | 8/2014 | Nakano | H01Q 1/2266 343/702 |
| 2006/0066488 | A1 * | 3/2006 | Zhinong | H01Q 1/243 343/702 |
| 2011/0227803 | A1 | 9/2011 | Nakano et al. | |

FOREIGN PATENT DOCUMENTS

| | | | |
|---|---|---|---|
| JP | 2010-531574 | A | 9/2010 |
| JP | 2011-199494 | A | 10/2011 |

* cited by examiner

ELECTRONIC DEVICE

CROSS-REFERENCE TO RELATED APPLICATION

The present application is a national phase entry under 35 U.S.C. §371 of International Application No. PCT/JP2012/077053 filed Oct. 19, 2012, published on May 23, 2013 as WO 2013/073334 A1, which claims priority from Japanese Patent Application No. JP 2011-251696, filed in the Japanese Patent Office on Nov. 17, 2011.

TECHNICAL FIELD

The present disclosure is generally related to an electronic device, and more particularly, to an electronic device having an antenna.

BACKGROUND ART

For example, an inverted-F antenna is known as an antenna to be mounted on an electronic device. As an example, Patent Literature 1 discloses an inverted-F antenna that is capable of adjusting the inductance and capacitance by the length and area, respectively, of a power supply line disposed parallel to a radiation patch.

Here, when the case of an electronic device is composed of a conductor such as a metal like magnesium alloy, in order to ensure the radiation characteristic of the antenna like the above provided within the case, the case is provided with an opening in many cases. An antenna cover composed of a resin or the like is installed on the opening.

CITATION LIST

Patent Literature

Patent Literature 1: JP 2003-318640A

SUMMARY OF INVENTION

Technical Problem

However, the opening and the antenna cover, which are provided in the case, have an effect on the appearance of the electronic device. From a viewpoint of restriction on the appearance design of the electronic device, it is desirable that no opening or antenna cover is provided.

Thus, the present disclosure proposes a novel and improved electronic device that is capable of improving the radiation characteristic of an antenna provided within the case while reducing effect on the appearance of the electronic device.

Solution to Problem

According to an embodiment of the present disclosure, there is provided an electronic device including: a case having a conductor part; and an antenna that is provided on a case surface on an inner side of the conductor part and has an antenna element extending in a first direction parallel to the case surface, the antenna element being grounded to the case surface, wherein a slit extending in the first direction is formed in an area of the case surface, the area being in parallel with the antenna element.

According to the above-described configuration, when radio waves are emitted from the antenna, the vicinity of the slit provided on the case surface as a conductor part is excited, and thus it is possible to cause excitation. That is, the area, in which the slit of the case surface is formed, is caused to operate as a parasitic element of the antenna, and thus the radiation characteristic of the antenna can be improved.

Advantageous Effects of Invention

As described above, according to the present disclosure, the radiation characteristic of the antenna provided within the case can be improved while reducing effect on the appearance of the electronic device.

DESCRIPTION OF EMBODIMENTS

The preferred embodiments of the present disclosure will be described in detail with reference to the accompanying drawings. In the present description and the drawings, constituent components having substantially the same functional configuration are labeled with the same symbols, and redundant description will be omitted.

The description will be given in the following order.

1. First embodiment (example in which a single slit is formed)
2. Second embodiment (example in which a parasitic element is added)
3. Third embodiment (example in which a plurality of slits are formed)
4. Summary

1. First Embodiment

Entire Configuration of Electronic Device

First, the entire configuration of an electronic device according to a first embodiment of the present disclosure will be described with reference to FIG. 1.

Figure 1:
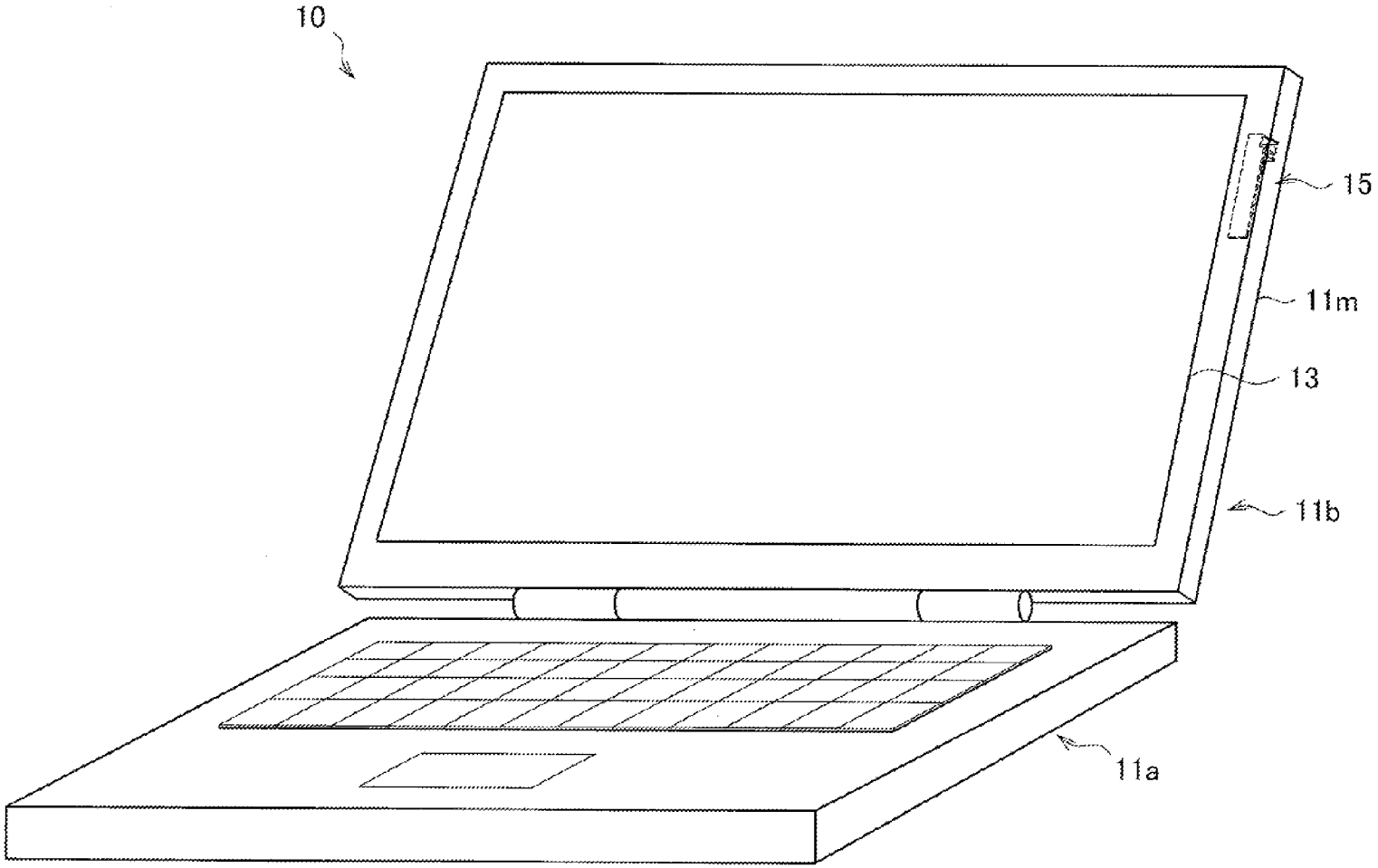
FIG. 1 is an illustration showing an electronic device according to a first embodiment of the present disclosure.

FIG. 1 is an illustration showing the electronic device according to the first embodiment of the present disclosure. As illustrated, the electronic device according to the first embodiment of the present disclosure is a notebook PC (Personal Computer) 10. In other embodiments, the electronic device may be one of various types of devices such as a tablet PC, a mobile phone, a smart phone, or a mobile game console other than a notebook PC.

The notebook PC 10 has a case 11. The case 11 has a conductor part 11*m* which is composed of magnesium alloy, aluminum alloy or the like. A portion other than the conductor part 11*m* of the case 11 may be composed of a material other than a conductor, such as a resin, for example.

Here, in the present embodiment, the case 11 has a double fold structure including a main body part 11*a* and a display part 11*b*. The main body part 11*a* is a part which has, for example, a keyboard or a touchpad on its surface and includes a circuit substrate, a hard disk or the like inside the part. The display part 11*b* is a part which is provided with a display 13 on one of the surfaces of the part serving as a display surface. The display 13 is, for example, an LCD (Liquid Crystal Display) and displays a result of computation in the notebook PC 10.

In the following description, for the case 11 in the display part 11*b*, one side of the display 13 serving as the display surface is referred to as the display surface side, and the other side is referred to as the back panel side. In the present embodiment, the back panel side of the display part 11*b* is the conductor part 11*m* of the case 11. The conductor part has a bathtub structure surrounding the display 13, and forms the rear surface on the back panel side of the display part 11*b* and a rib part on the lateral surface of the display part 11*b*. Part of the case 11 surrounding the display surface side of the display part 11*b*, that is, the display surface of the display 13 is formed of a resin cover.

An antenna unit 15 is provided on the inner side of a case surface of the above-mentioned conductor part 11*m*. The antenna unit 15 is a unit that includes an antenna connected to a communication circuit of the notebook PC 10 and configured to transmit and receive radio waves. More specifically, the antenna unit 15 is provided on the inner side of the case surface of the conductor part 11*m* on the peripheral edge of the display 13. As described below, an antenna included in the antenna unit 15 is grounded to the case surface on the inner side of the conductor part 11*m*. That is, in this area, the case surface relates to the function of the antenna unit 15 as a grounding surface. Thus, in the following description, the case surface in the vicinity of the antenna unit 15 may also be referred to as the antenna unit 15.

As is apparent by reference to the below description of the antenna unit 15, the arrangement of the antenna unit in the embodiments of the present disclosure is not particularly limited as long as the antenna is grounded to the case surface of the conductor part of the case. Therefore, the antenna unit is not necessarily provided on the peripheral edge of the display, and may be provided at an arbitrary position depending on the type of the electronic device. In addition, the electronic device does not necessarily need to have a display.

As is apparent to those skilled in the art, the notebook PC 10 may include various types of elements to be used to achieve its function other than the above-mentioned elements.

(Configuration of Antenna Unit)

Hereinafter, the configuration of the antenna unit of the electronic device according to the first embodiment of the present disclosure will be described with reference to FIG. 2.

Figure 2:
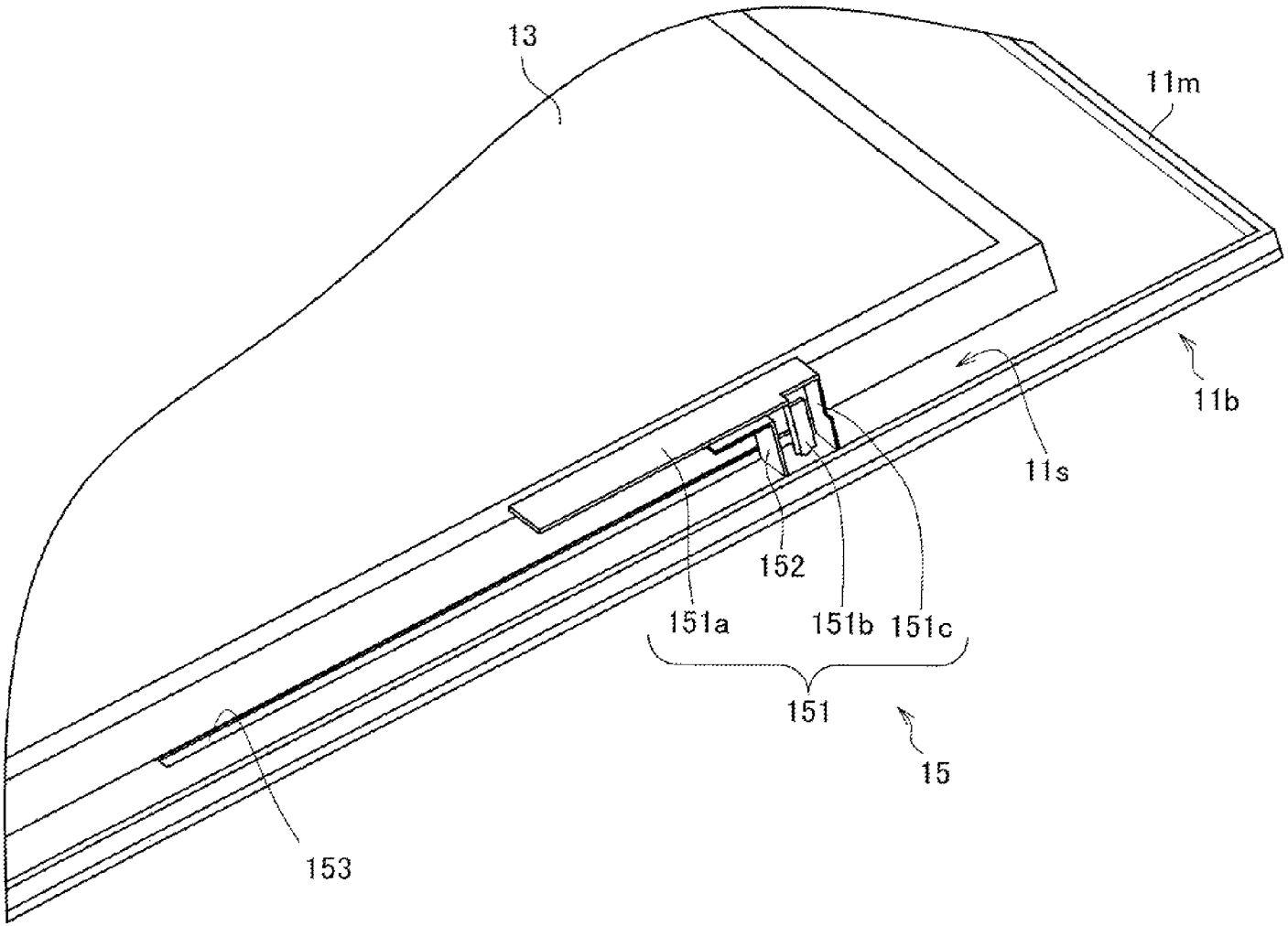
FIG. 2 is an illustration showing an antenna unit of the electronic device according to the first embodiment of the present disclosure.

FIG. 2 is an illustration showing the antenna unit of the electronic device according to the first embodiment of the present disclosure. As illustrated, the antenna unit 15 of the notebook PC 10 includes an antenna 151, a parasitic element 152, and a slit 153. In the present embodiment, the antenna unit 15 is provided on the inner side of a case surface 11*s* of the conductor part 11*m* of the case 11, on the peripheral edge of the display 13.

Here, the antenna 151 is grounded to the case surface 11*s* of the conductor part 11*m*, which is on the back panel side of the display part 11*b* of the case 11. It is to be noted that a resin cover, which forms the surface on the display surface side of the display part 11*b*, is not illustrated for the purpose of description. As described above, the arrangement of the antenna unit in the embodiments of the present disclosure is not particularly limited as long as the antenna is grounded to the case surface of the conductor part of the case. Therefore, for example, when the surface on the display surface side of the display part 11*b* is also composed of a conductor, the antenna 151 may be grounded to the surface on the display surface side.

The antenna 151 is an inverted-F antenna that has an antenna element 151*a*, a power supply pin 151*b*, and a short pin 151*c*. The antenna element 151*a* is an antenna element that extends in a direction parallel to the case surface 11*s*. The power supply pin 151*b* is provided near a fixed end of the antenna element 151*a*, and is connected to a communication circuit (not illustrated) of the notebook PC 10. The short pin 151*c* is provided at the fixed end of the antenna element 151*a* so as to ground the antenna element 151*a* to the case surface 11*s*.

In the present embodiment, the antenna element 151*a* or the installation pin 151*c* is provided with a notch as illustrated in order to perform bending processing for the antenna 151 using a single metal sheet. The antenna 151, however, may be processed by another method and in that case, the above-mentioned notch may not be provided.

Although the size of the antenna 151 is not particularly limited, it is desirable to reduce its height as much as possible, for example, by using the space on the inner side of the display part 11*b*. The space interval between the display 13 and the antenna 151, and the space interval between the rib part on the lateral surface of the display part 11*b* and the antenna 151 may be appropriately set in consideration of ease of installment, for example.

The parasitic element 152 is an inverted-L parasitic element that is disposed between the antenna element 151*a* and the case 11, and extends in the same direction as the antenna element 151*a*. The parasitic element 152 is additionally provided in order to improve the radiation characteristic of the antenna 151. In the present embodiment, the radiation characteristic of the antenna 151 in a plurality of frequency bands is improved by providing the parasitic element 152. That is, the parasitic element 152 contributes to dual band operation of the antenna 151.

The slit 153 is a slit that is formed in an area of the case surface 11*s* in parallel with the antenna element 151*a*, and extends in the same direction as the antenna element 151*a*. The slit 153 extends adjacent to the long side of the antenna element 151*a* when viewed from the above in FIG. 2.

Here, as illustrated, "an area of the case surface 11*s* in parallel with the antenna element 151*a*" indicates an area or its nearby area of the case surface 11*s* located under the antenna element 151*a* or at a lower level of the antenna element 151*a*. The slit 153 does not necessarily overlap with the antenna element 151*a* when viewed from the above in FIG. 2, and may be adjacent to the antenna element 151*a* or may be spaced from the antenna element 151*a*. As described below, the slit 153 has a function of causing excitation to the nearby case surface 11*s* by radiating radio waves from the antenna element 151*a*, and thus the position of the slit 153 is not particularly limited as long as the position is in a range allowing the function to be achieved.

The slit 153 extends in a direction toward the open end of the antenna element 151*a* from a start point at the position of the short pin 151*c* of the antenna 151, that is, the position of the fixed end of the antenna element 151*a*. In the illustrated example, the end point of the slit 153 is ahead of the open end of the antenna element 151*a*. However, without being limited to this, the positional relationship between the end point of the slit 153 and the open end of the antenna element 151*a* is arbitrary.

The slit 153 described above functions as a parasitic element of the antenna 151. That is, in response to the radiation from the antenna element 151*a*, the portion of the slit 153 of the case surface 11*s* is excited and excitation occurs. This enables the radiation characteristic of the antenna 151 to be improved.

The length of the slit 153 is preferably, for example, 4/9 to ½ of a wavelength corresponding to the frequency of the excitation of the slit 153 portion of the case surface 11*s*. This is because an appropriate length of the slit 153 for exciting the slit 153 portion of the case surface 11*s* is made shorter than ½ of a wavelength corresponding to the frequency of the excitation due to the shape of the slit 153, the shape of the case surface 11*s* in the periphery of the slit 153, or whether or not dielectric materials are disposed for the slit 153. It is preferable that the frequency of the excitation be close to the frequency of the radiation from the antenna 151. The frequency of the excitation, however, is not necessarily the same as the frequency of the radiation.

Here, as described above, in general when an antenna is installed within a case of an electronic device, the case being composed of a conductor such as metal, it is often that an opening is provided in the case and an antenna cover is installed in the opening. When an opening is not provided, installation of an inverted-F antenna or the like to be grounded to the case surface (that is, a configuration in which the slit 153 is not provided in the present embodiment) may be made, and in this case, radiation to the rear surface side of the case surface will be reduced.

In addition, by forming a slit on the case surface and supplying power thereto, the case surface may be utilized as a slit antenna. However, when broadband performance demanded of an antenna for electronic devices in recent years is achieved using a slit antenna, the shape of the slit will be complicated. That is, in this case, a slit with a complicated shape is formed on the case surface, which is not preferable in view of the appearance design.

Thus, in the present embodiment, the slit 153 in a linear shape is formed on the surface of the case 11, the surface serving as GND of the antenna 151 as described above, and the slit 153 portion of the case surface 11*s* is made to function as a parasitic element. With this configuration, the slit formed on the case surface 11*s* can be simple in shape and the radiation characteristic of the antenna 151 can be improved with a minimum effect on the appearance design.

(Operation of Antenna Section)

Hereinafter, the operation of the antenna unit 15 based on simulation results will be described with reference to FIGS. 3 to 10. In the following simulations, the slit 153 has a length of 52 mm which is equivalent to 6/13 of the wavelength of radio waves having a frequency of 2.65 GHz.

Figure 3A:
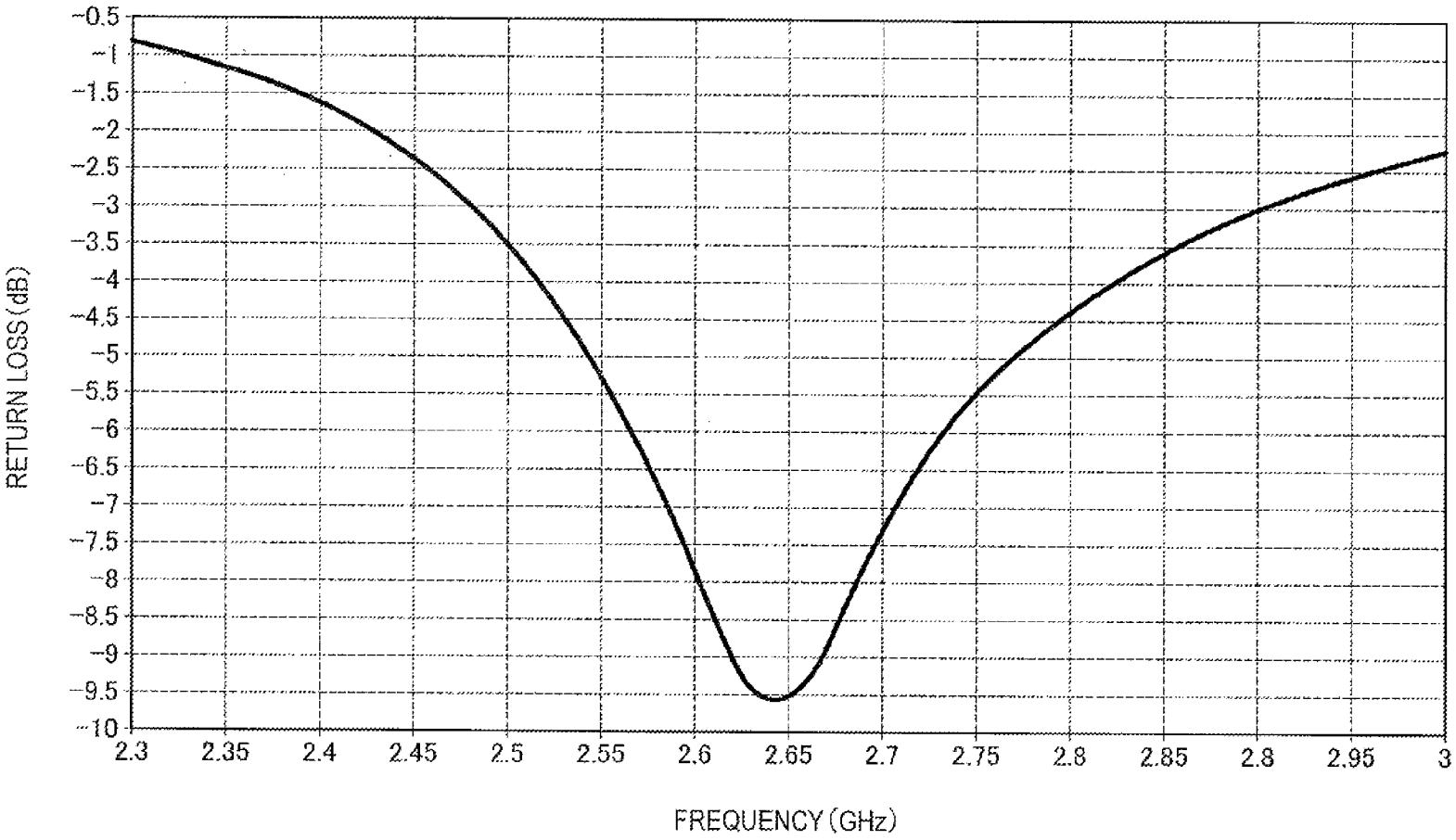
FIG. 3A is a graph showing a simulation result of return loss in a 2 GHz frequency band in the first embodiment of the present disclosure.
Figure 3B:
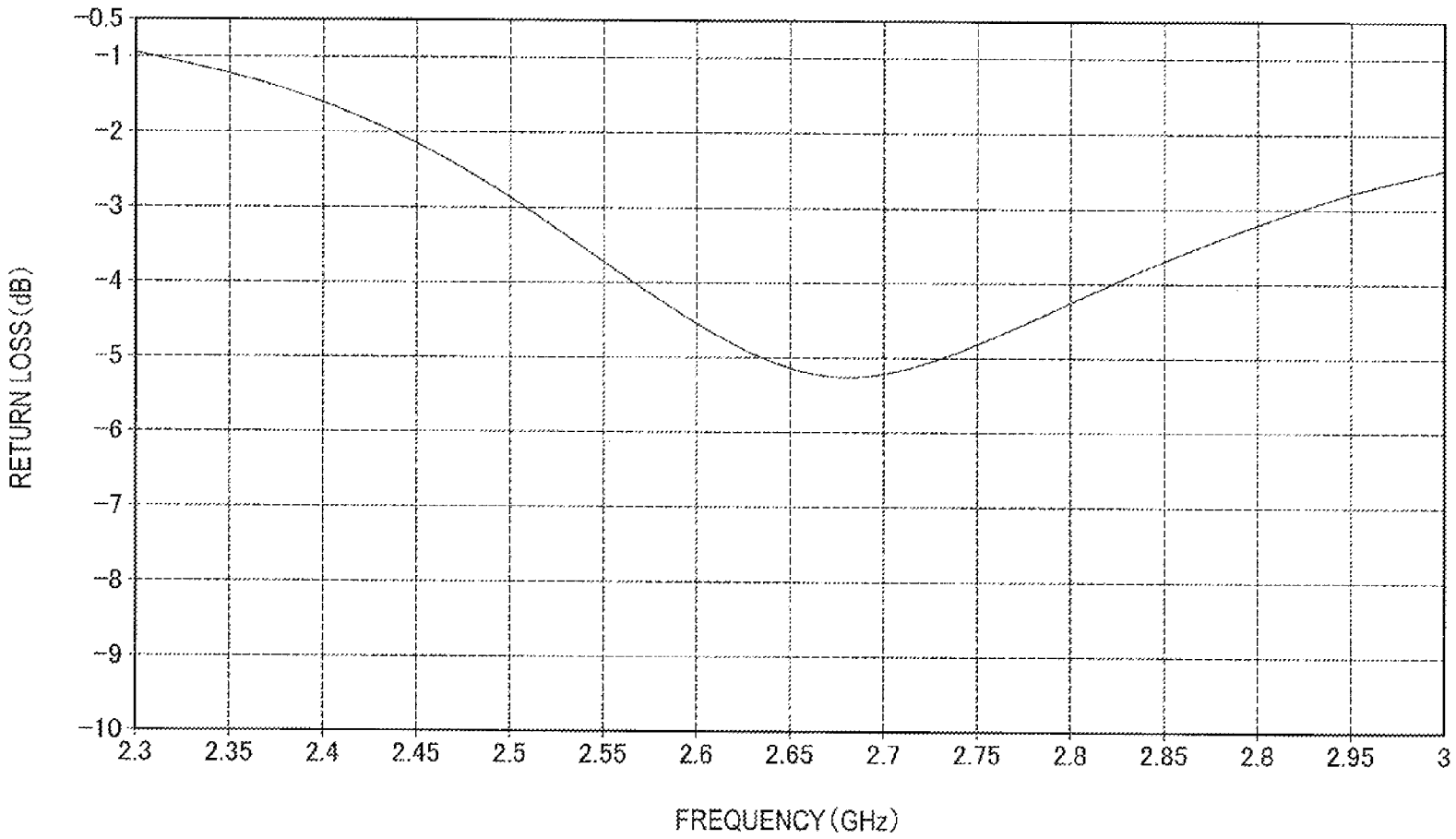
FIG. 3B is a graph showing a simulation result of return loss in a 2 GHz frequency band in the first embodiment of the present disclosure.

FIG. 3A is a graph showing a simulation result of return loss in a 2 GHz frequency band (frequency of 2.3 to 3 GHz) in the first embodiment of the present disclosure. FIG. 3B is a graph showing a similar simulation result in a comparative example in which the slit 153 is not provided. According to the result, the value of return loss was lower compared with the comparative example, particularly in a band centered at 2.65 GHz, and thus it can be seen that the matching characteristic has been improved by providing the slit 153.

Figure 4A:
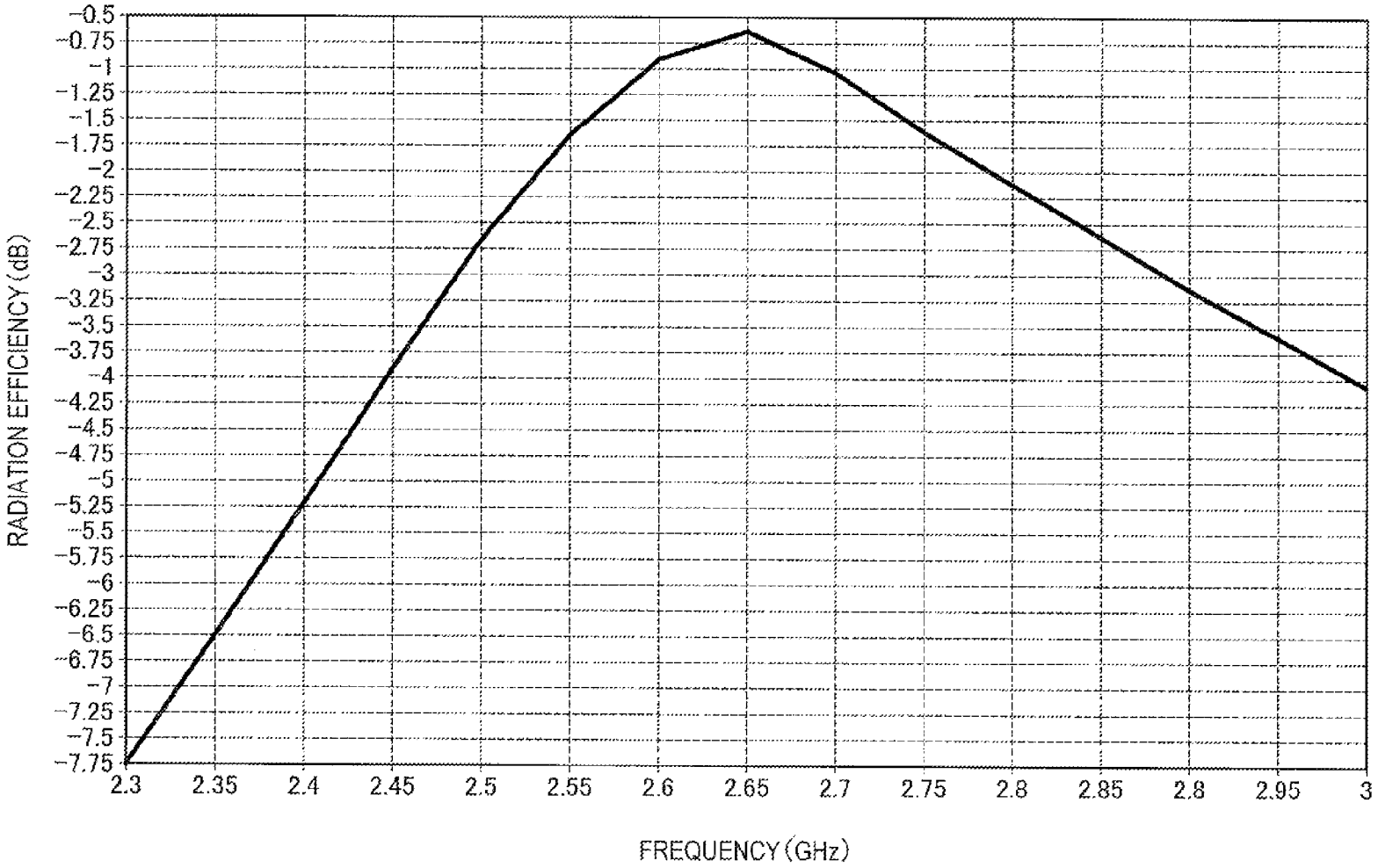
FIG. 4A is a graph showing a simulation result of radiation efficiency in a 2 GHz frequency band in the first embodiment of the present disclosure.
Figure 4B:
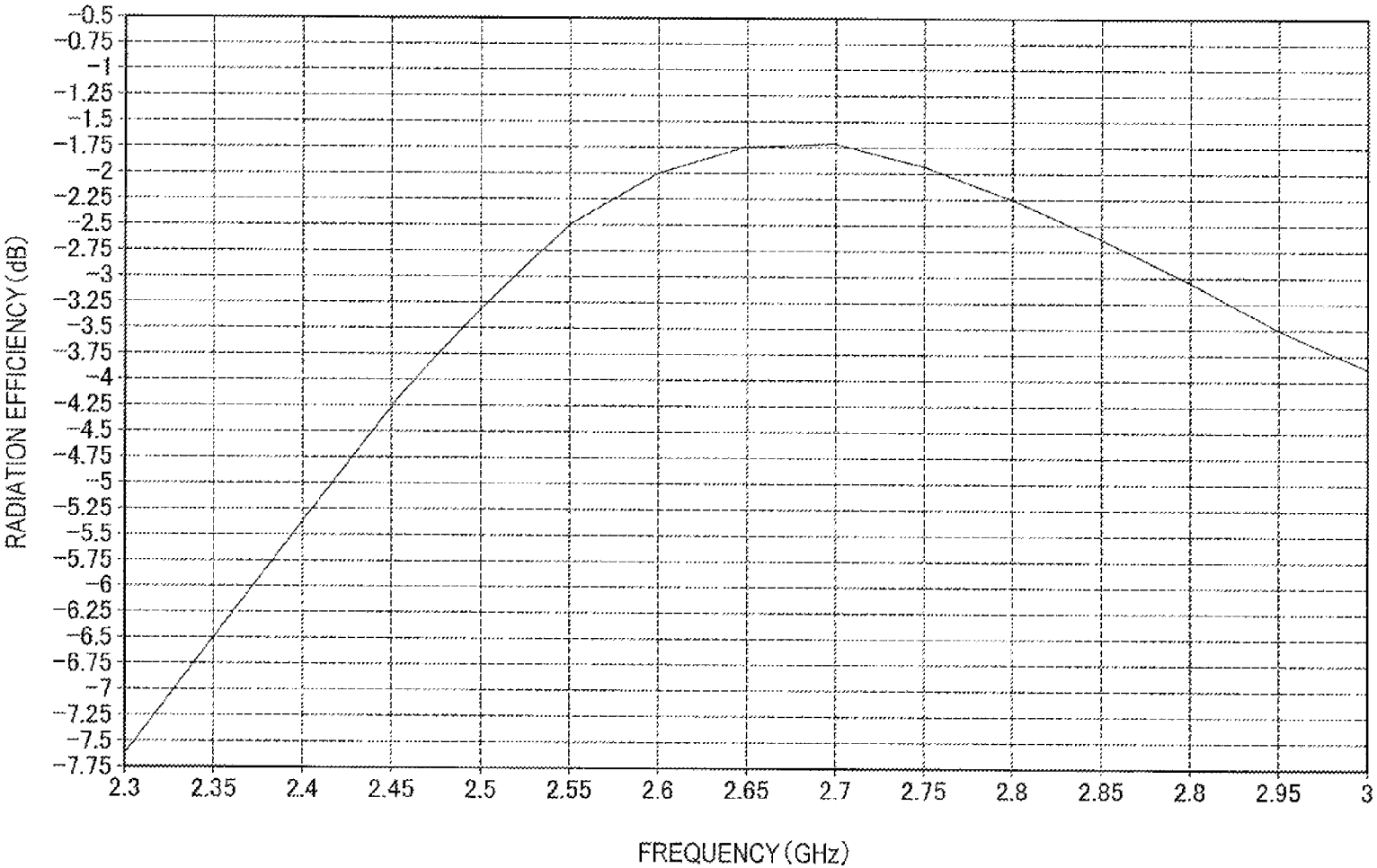
FIG. 4B is a graph showing a simulation result of radiation efficiency in a 2 GHz frequency band in the first embodiment of the present disclosure.

FIG. 4A is a graph showing a simulation result of radiation efficiency in a 2 GHz frequency band (frequency of 2.3 to 3 GHz) in the first embodiment of the present disclosure. FIG. 4B is a graph showing a similar simulation result of the comparative example in which the slit 153 is not provided. According to the result, it can be seen that in a band of 2.4 to 2.7 GHz, the radiation efficiency has been improved compared with the comparative example. More specifically, the radiation efficiency is comparable to that of the comparative example at the band edge of 2.4 GHz, and has been improved by an approximately 1 dB at the peak of the radiation efficiency.

Figure 5A:
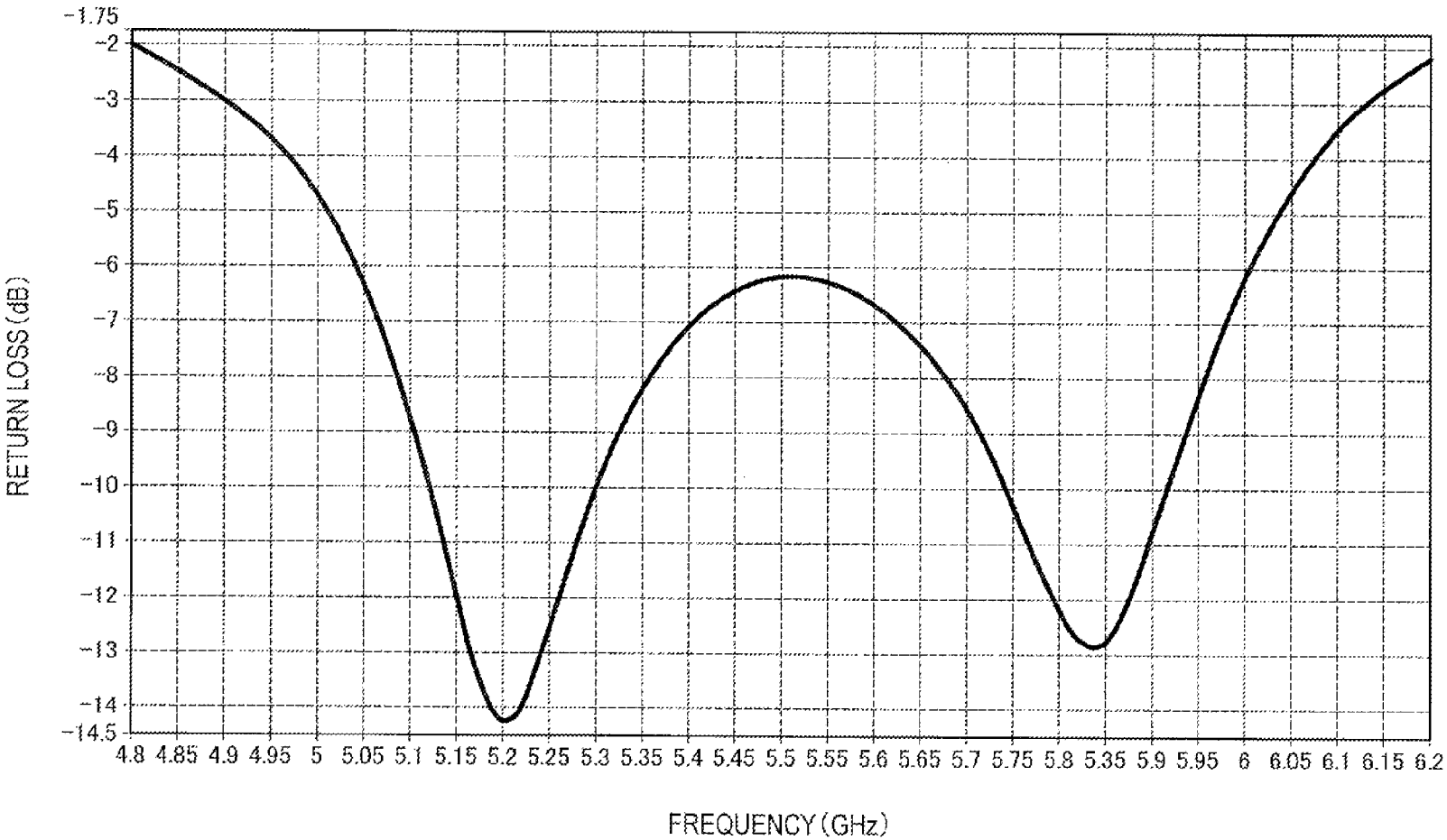
FIG. 5A is a graph showing a simulation result of return loss in a 5 GHz frequency band in the first embodiment of the present disclosure.
Figure 5B:
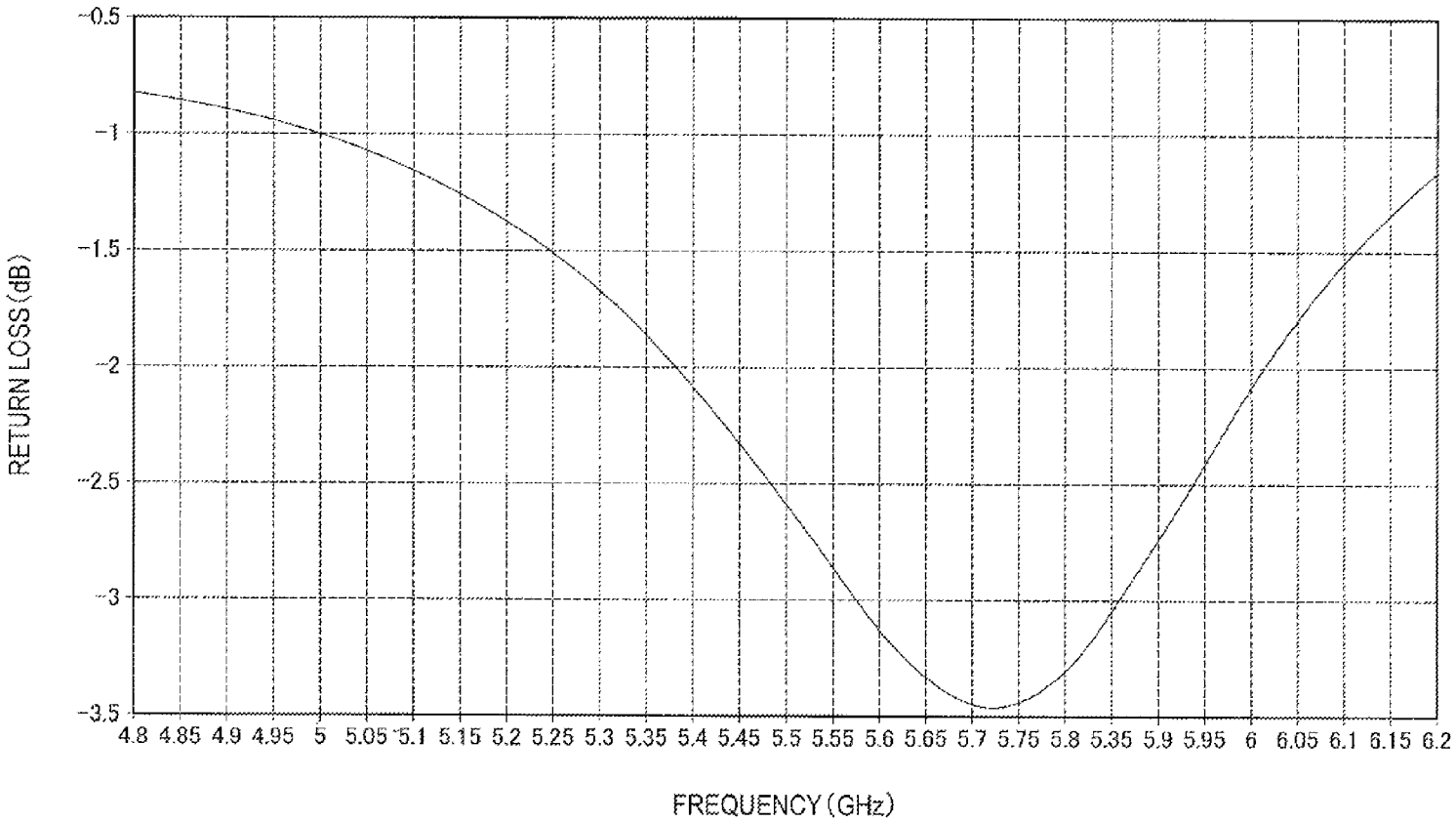
FIG. 5B is a graph showing a simulation result of return loss in a 5 GHz frequency band in the first embodiment of the present disclosure.

FIG. 5A is a graph showing a simulation result of return loss in a 5 GHz frequency band (frequency of 4.8 to 6.2 GHz) in the first embodiment of the present disclosure. FIG. 5B is a graph showing a similar simulation result of the comparative example in which the slit 153 is not provided. According to the result, a new matching point, which was not present in the comparative example, occurred at the frequency of 5.2 GHz. From this result, it can be concluded that the matching characteristic has been improved in a band of 5.15 to 5.85 GHz by providing the slit 153.

Figure 6A:
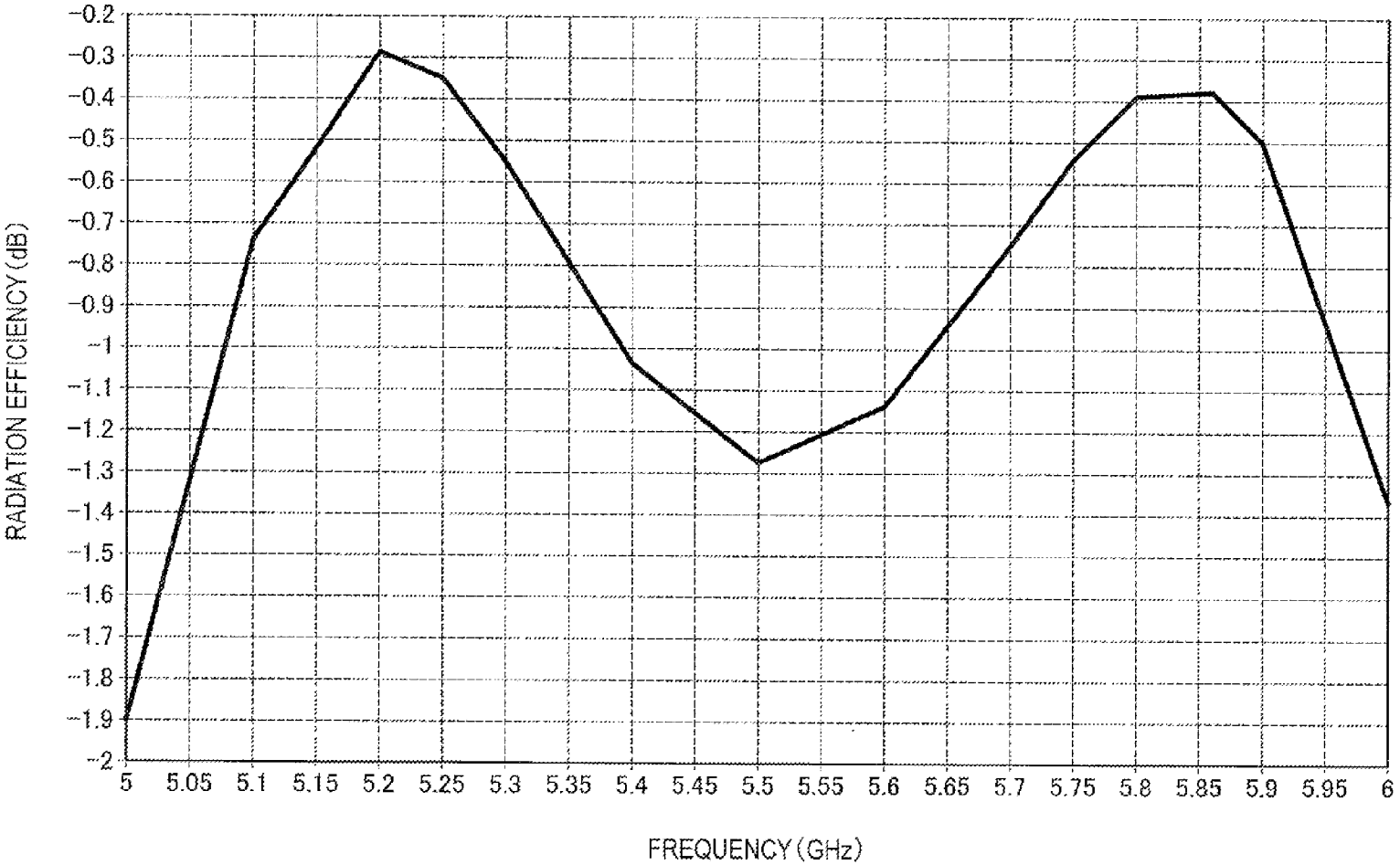
FIG. 6A is a graph showing a simulation result of radiation efficiency in a 5 GHz frequency band in the first embodiment of the present disclosure.
Figure 6B:
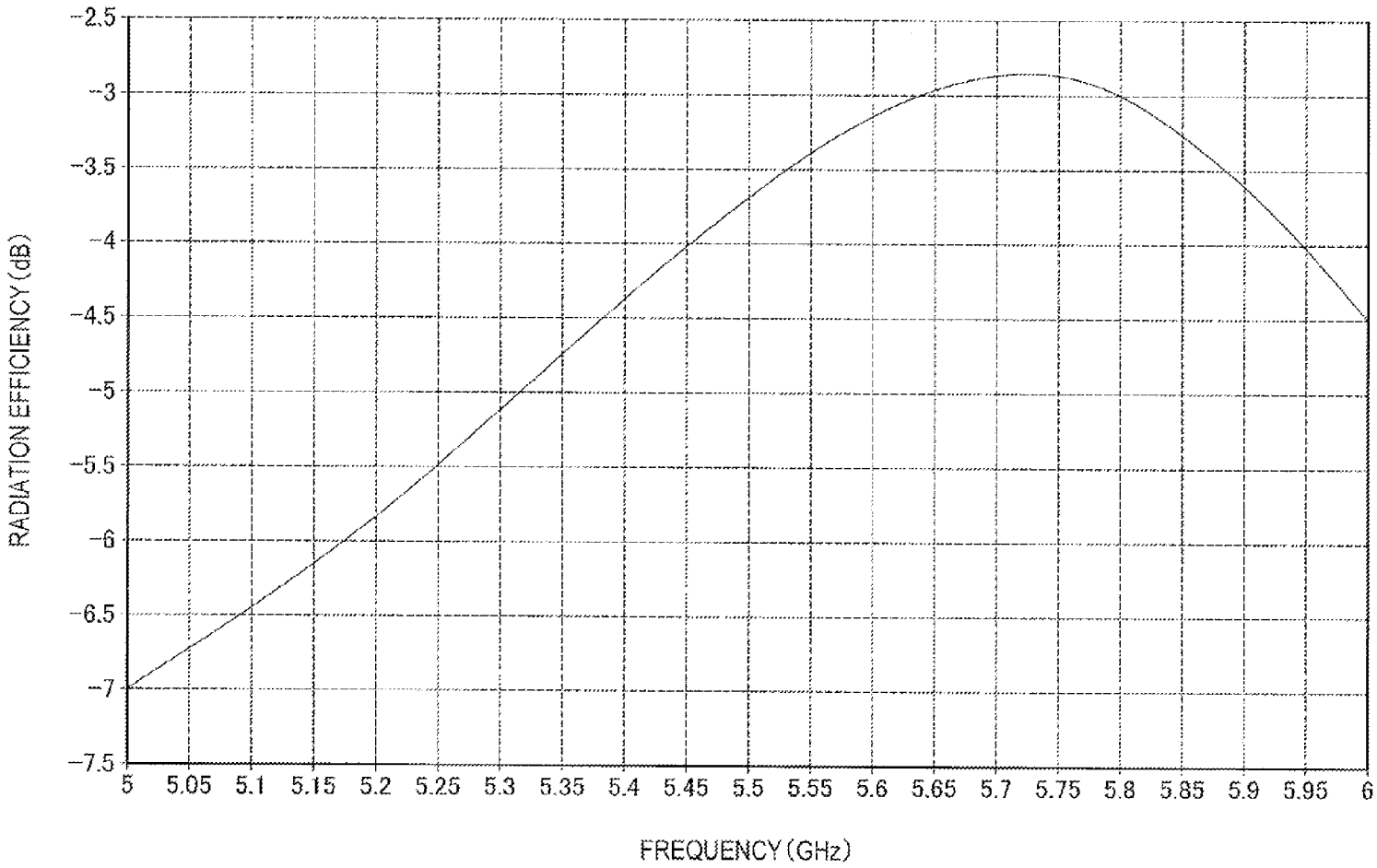
FIG. 6B is a graph showing a simulation result of radiation efficiency in a 5 GHz frequency band in the first embodiment of the present disclosure.

FIG. 6A is a graph showing a simulation result of radiation efficiency in a 5 GHz frequency band (frequency of 5 to 6 GHz) in the first embodiment of the present disclosure. FIG. 6B is a graph showing a similar simulation result of the comparative example in which the slit 153 is not provided. According to the result, it can be seen that the radiation efficiency characteristic was also improved in a band of 5.15 to 5.85 GHz due to the occurrence of the above-mentioned matching point.

Figure 7:
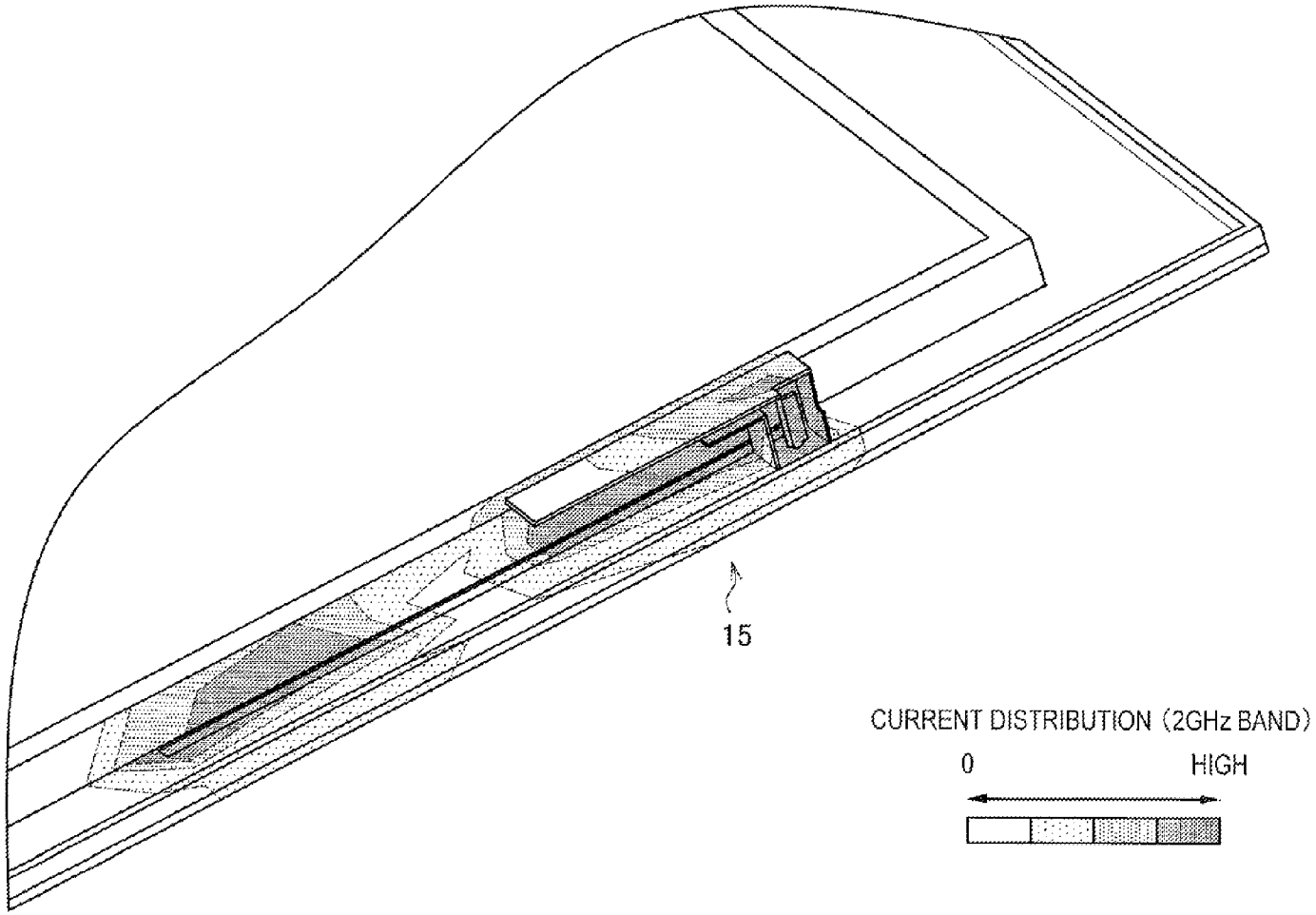
FIG. 7 is an illustration showing a simulation result of average current distribution in a 2 GHz frequency band in the first embodiment of the present disclosure.

FIG. 7 is an illustration showing a simulation result of average current distribution in a 2 GHz frequency band (frequency of 2.65 GHz) in the first embodiment of the present disclosure. According to the result, it can be seen that the slit 153 portion of the case surface 11*s* was excited and excitation occurred. The wavelength of the excitation occurred in the slit 153 portion of the case surface 11*s* is approximately ½ of the length of the slit 153. Such an excitation of the conductor part 11*m* of the case, serving as GND, was not observed in the comparative example in which the slit 153 was not provided, and thus it can be concluded that the excitation is an effect that is achieved by providing the slit 153.

Figure 8:
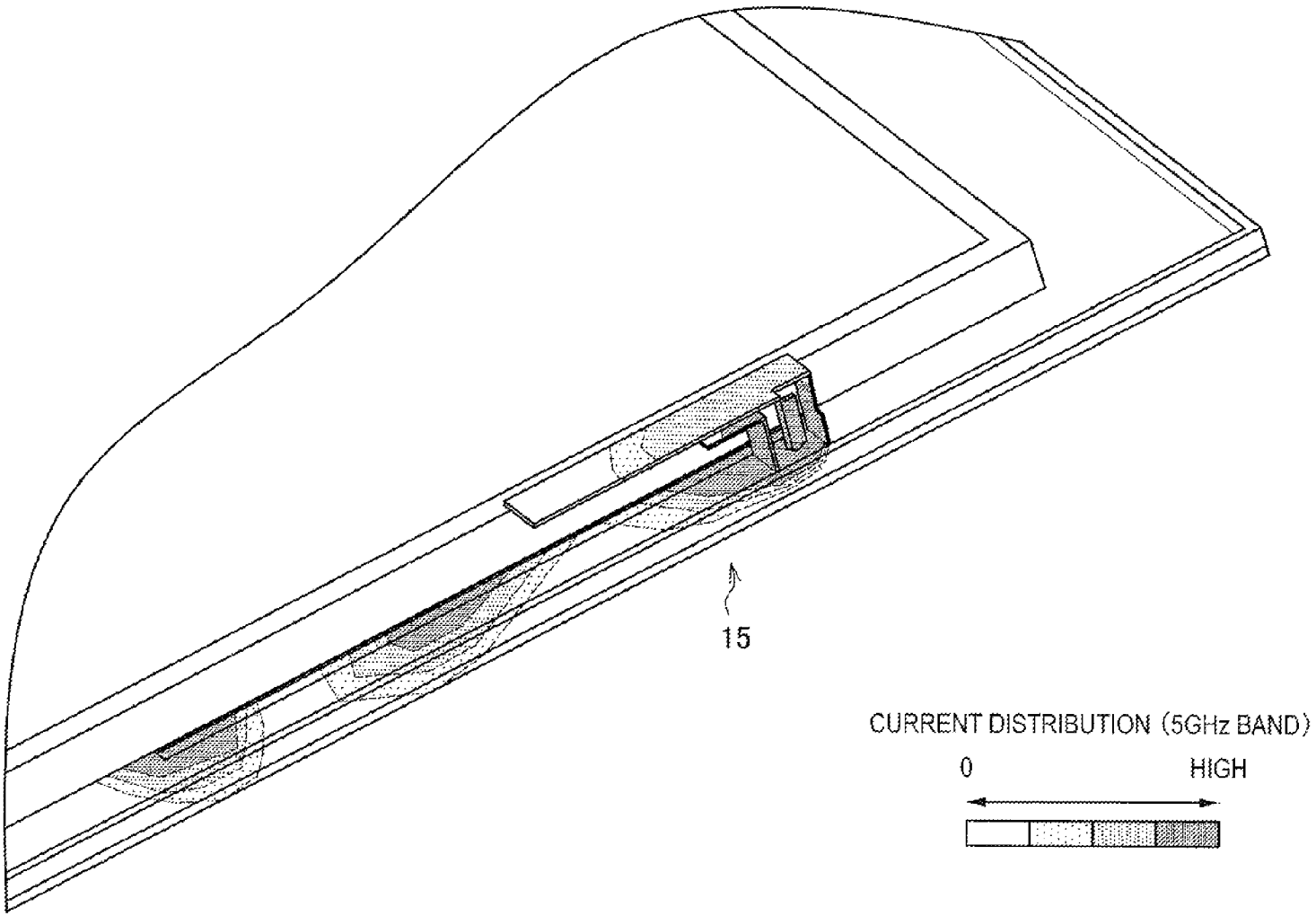
FIG. 8 is an illustration showing a simulation result of average current distribution in a 5 GHz frequency band in the first embodiment of the present disclosure.

FIG. 8 is an illustration showing a simulation result of average current distribution in a 5 GHz frequency band (frequency of 5.25 GHz) in the first embodiment of the present disclosure. According to the result, similarly to the case of the above-mentioned frequency band of 2 GHz, it can be seen that the slit 153 portion of the case surface 11*s* was excited and excitation occurred. The wavelength of the excitation occurred in the slit 153 portion of the case surface 11*s* is approximately the same as the length of the slit 153. By setting the length of the slit 153 appropriately in this manner, excitation is made to occur in a plurality of desired bands, and thus the radiation characteristic of the antenna 151 can be improved by using the slit 153 portion of the case 11 as a parasitic element.

Figure 9:
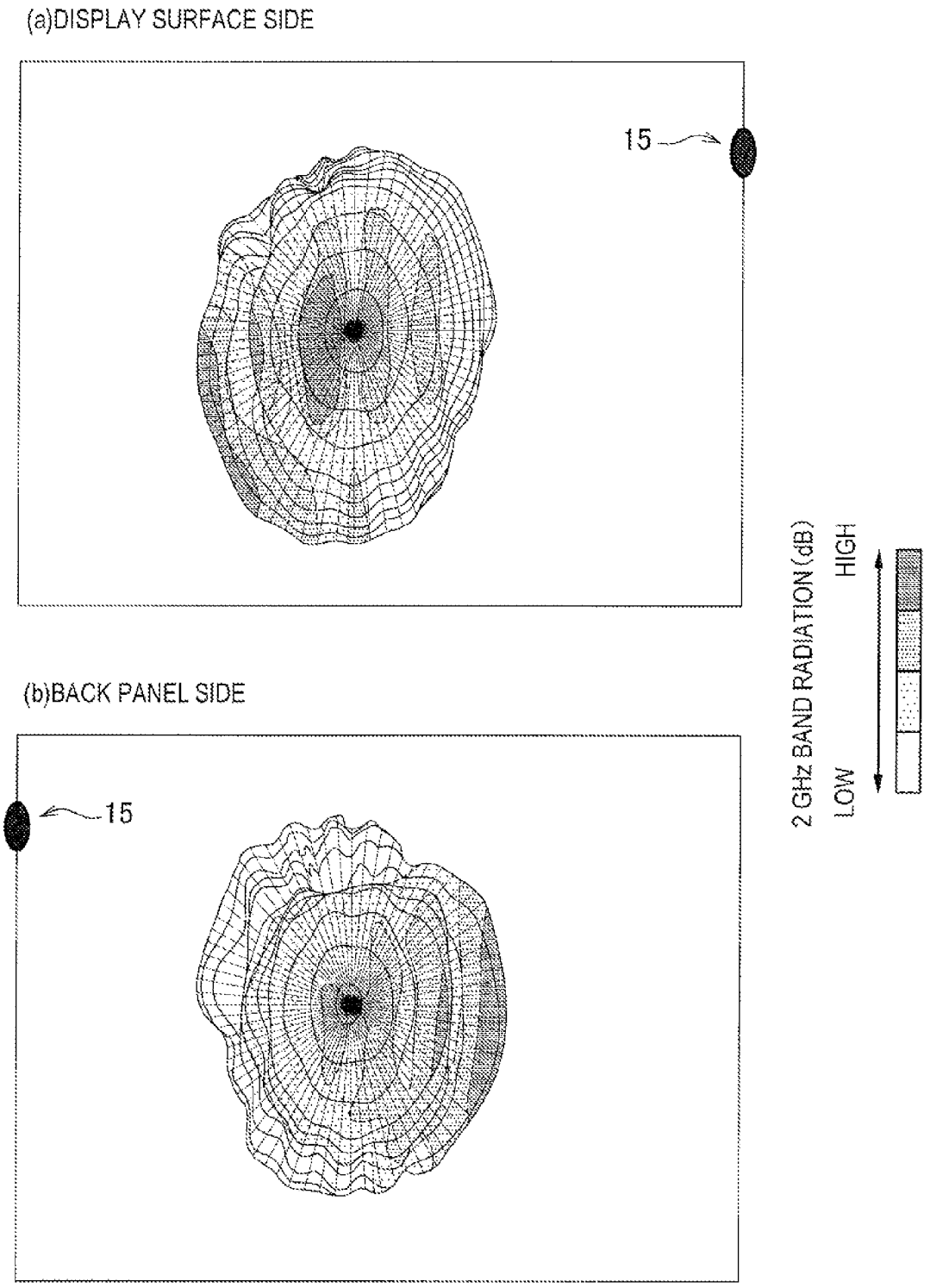
FIG. 9 is an illustration showing a simulation result of radiation pattern in a 2 GHz frequency band in the first embodiment of the present disclosure.

FIG. 9 is an illustration showing a simulation result of radiation pattern in a 2 GHz frequency band (frequency of 2.65 GHz) in the first embodiment of the present disclosure. According to the result, it can be seen that relatively intense radiation occurred each on the display surface side illustrated in (a) and on the back panel side illustrated in (b). Consequently, it can be concluded that in the present embodiment, the radiation from the antenna in a 2 GHz frequency band exhibits nearly non-directional characteristic due to the slit 153 provided.

Figure 10:
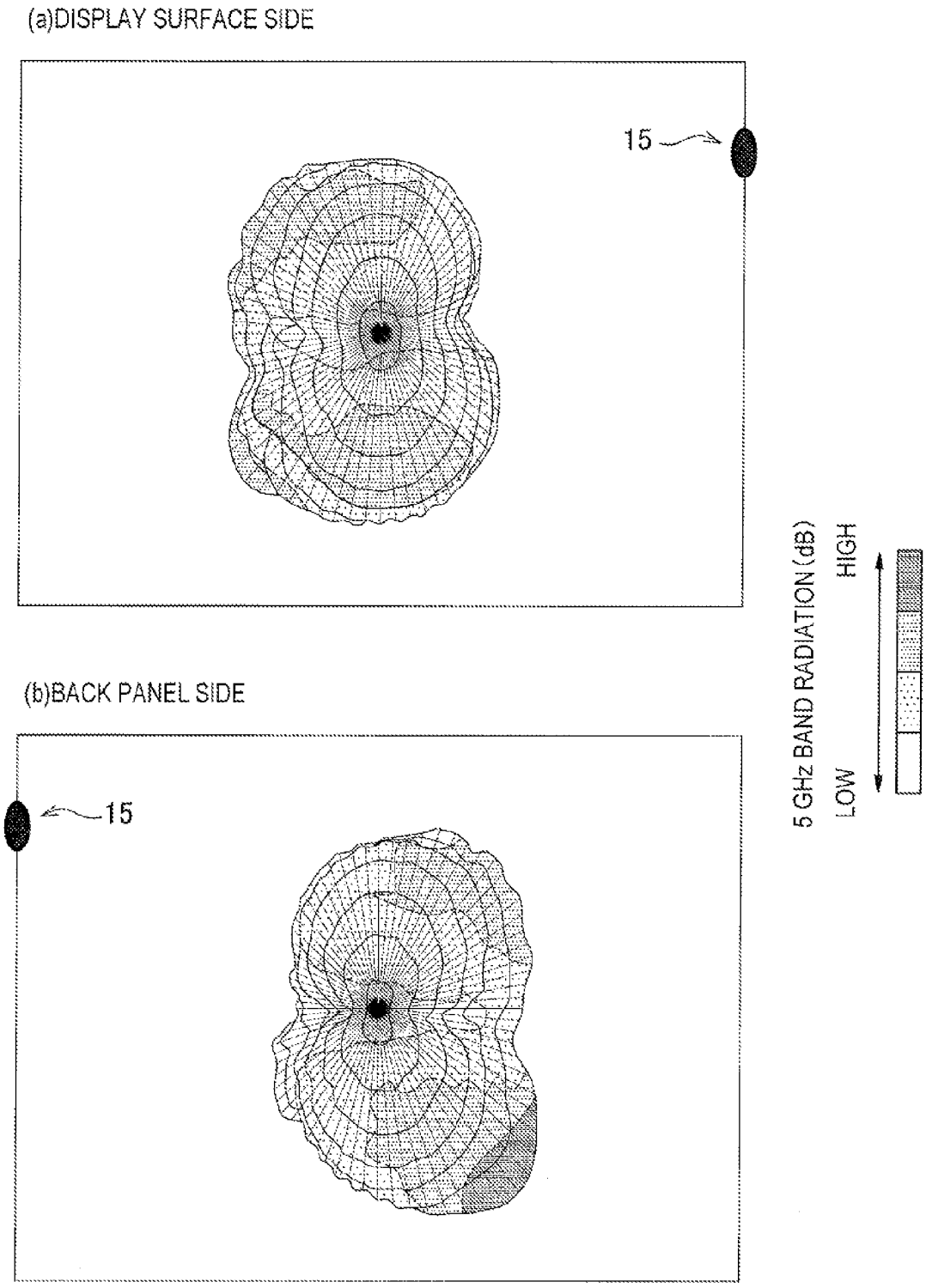
FIG. 10 is an illustration showing a simulation result of radiation pattern in a 5 GHz frequency band in the first embodiment of the present disclosure.

FIG. 10 is an illustration showing a simulation result of radiation pattern in a 5 GHz frequency band (frequency of 5.2 GHz) in the first embodiment of the present disclosure. According to the result, similarly to the case of a frequency band of 2 GHz, it can be seen that relatively intense radiation occurred each on the display surface side illustrated in (a) and on the back panel side illustrated in (b). Consequently, it can be concluded that in the present embodiment, the radiation from the antenna in the 5 GHz frequency band also exhibits nearly non-directional characteristic due to the slit 153 provided.

2. Second Embodiment

Hereinafter, a second embodiment of the present disclosure will be described. Although the second embodiment of the present disclosure is different from the above-described first embodiment in that a parasitic element is added to the antenna unit, except this, the second embodiment has a configuration in common with the first embodiment. Thus, a detailed description for the configuration in common will be omitted.

(Configuration of Antenna Section)

First, the configuration of an antenna unit of an electronic device according to a second embodiment of the present disclosure will be described with reference to FIG. 11.

Figure 11:
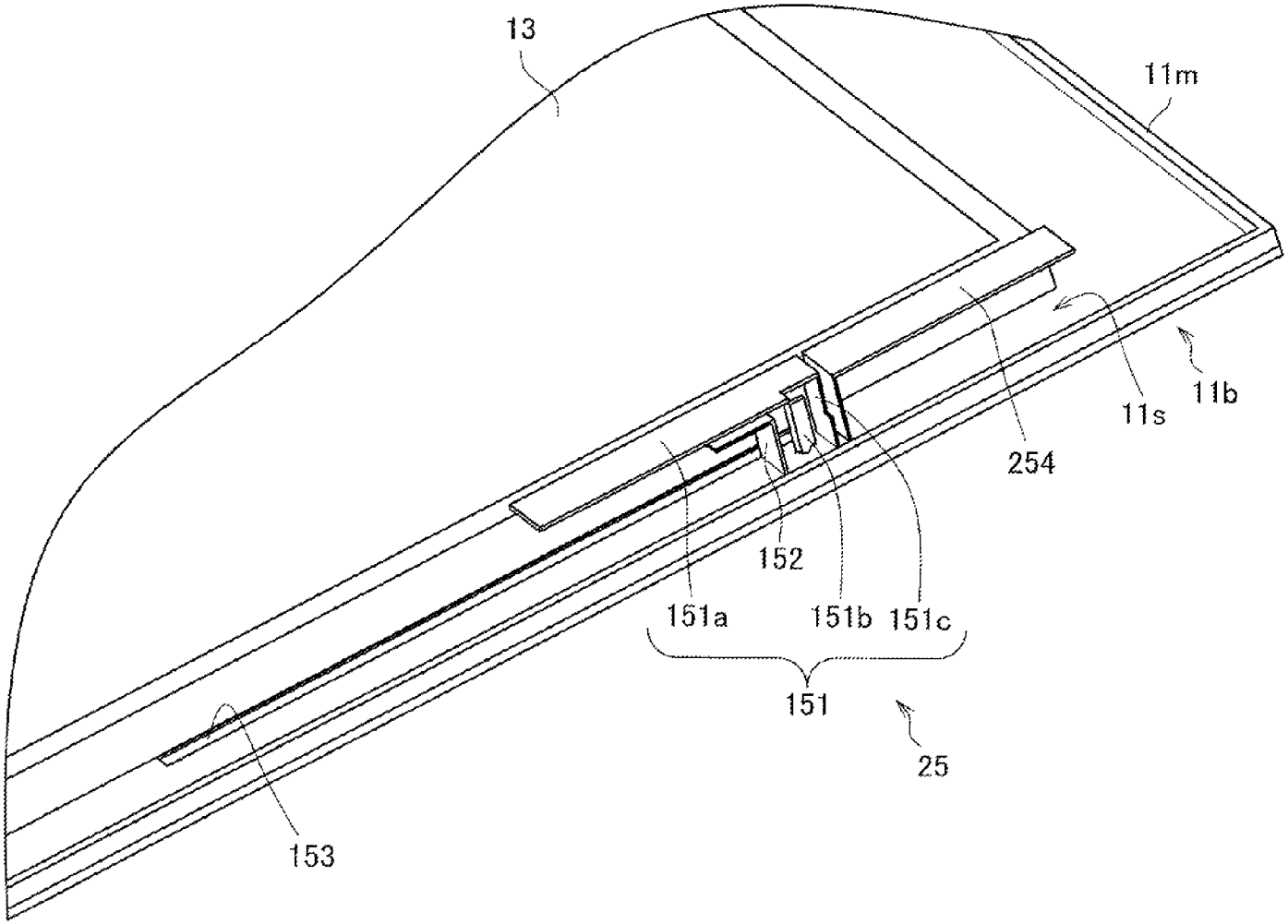
FIG. 11 is an illustration showing an antenna unit of an electronic device according to a second embodiment of the present disclosure.

FIG. 11 is an illustration showing the antenna unit of the electronic device according to the second embodiment of the present disclosure. As illustrated, an antenna unit 25 of the notebook PC 10 includes the antenna 151, the parasitic element 152, the slit 153, and a parasitic element 254. Because the antenna 151, the parasitic element 152, and the slit 153 each have the same configuration as that of the above-described first embodiment, a detailed description thereof will be omitted.

The parasitic element 254 is an inverted-L parasitic element extending in a direction away from the antenna 151, that is, disposed subsequent to the antenna element 151*a* with respect to the extending direction of the antenna element 151*a*. Similarly to the parasitic element 152, the parasitic element 254 is also additionally provided in order to improve the radiation characteristic of the antenna 151. In the present embodiment, a frequency band, in which favorable radiation characteristic is achieved by the antenna 151, is increased by providing the parasitic element 254. That is, the parasitic element 254 contributes to broadbandization of the antenna 151. It is to be noted that the distance between the antenna 151 and the parasitic element 254 is suitably set, for example, in consideration of the space for wiring a power supply line to the power supply pin 151*b* of the antenna 151.

(Operation of Antenna Unit)

Hereinafter, the operation of the antenna unit 25 based on simulation results will be described with reference to FIGS. 12 to 19. In the following simulations, the slit 153 has a length of 52 mm which is equivalent to 6/13 of the wavelength of radio waves having a frequency of 2.65 GHz.

Figure 12A:
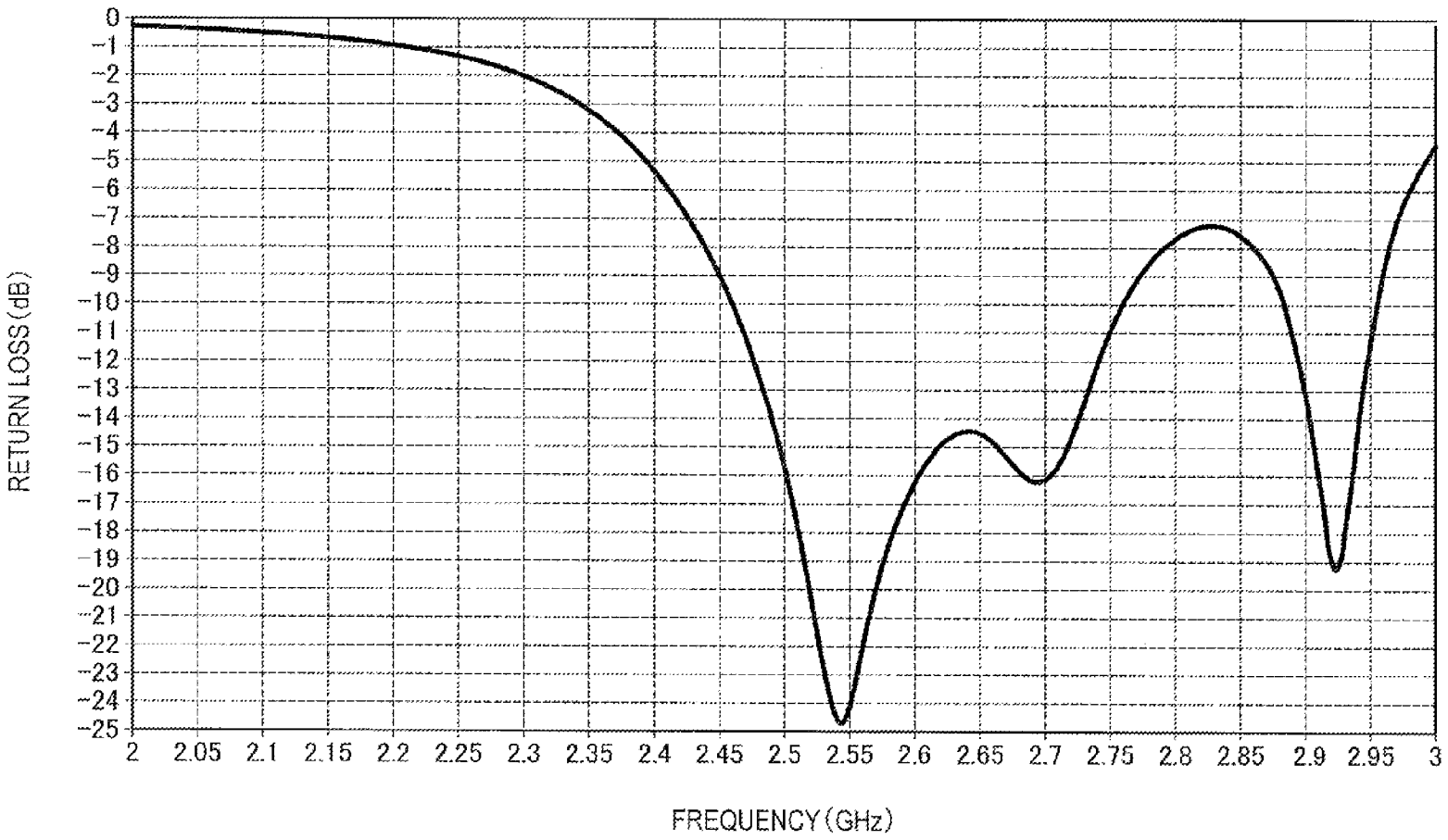
FIG. 12A is a graph showing a simulation result of return loss in a 2 GHz frequency band in the second embodiment of the present disclosure.
Figure 12B:
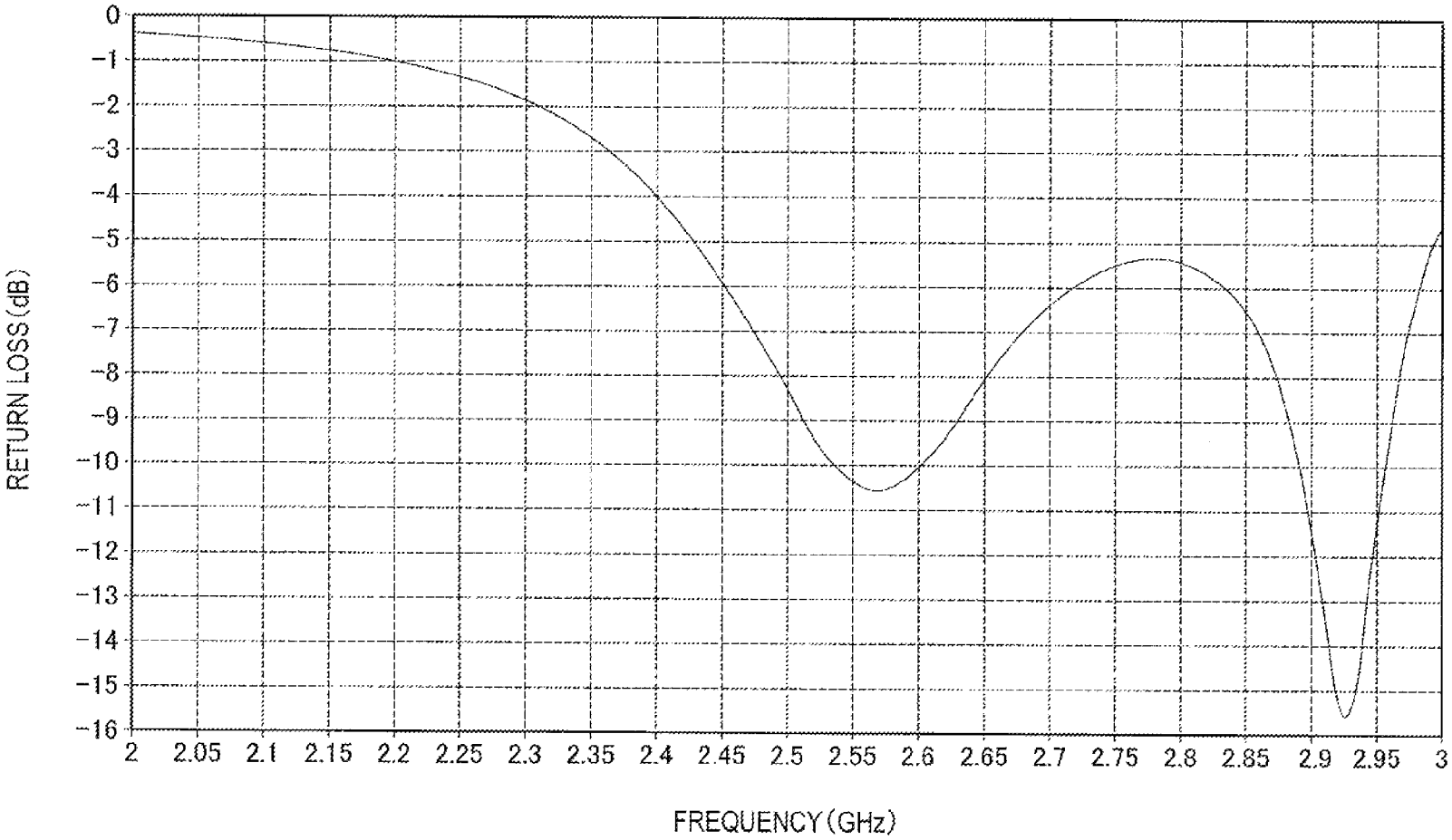
FIG. 12B is a graph showing a simulation result of return loss in a 2 GHz frequency band in the second embodiment of the present disclosure.

FIG. 12A is a graph showing a simulation result of return loss in a 2 GHz frequency band (frequency of 2 to 3 GHz) in the second embodiment of the present disclosure. FIG. 12B is a graph showing a similar simulation result of the comparative example in which the slit 153 is not provided. According to the result, it can be seen that a new matching point, which was not present in the comparative example, occurred at the frequency of 2.7 GHz. From this result, it can be concluded that the matching characteristic has been improved in a band of 2 to 3 GHz by providing the slit 153. In contrast to the simulation result of the first embodiment illustrated in FIG. 3A, a frequency band, in which the matching characteristic is high, has extended to a band of 2.7 to 3 GHz, and thus the effect of the parasitic element 254 has been demonstrated.

Figure 13A:
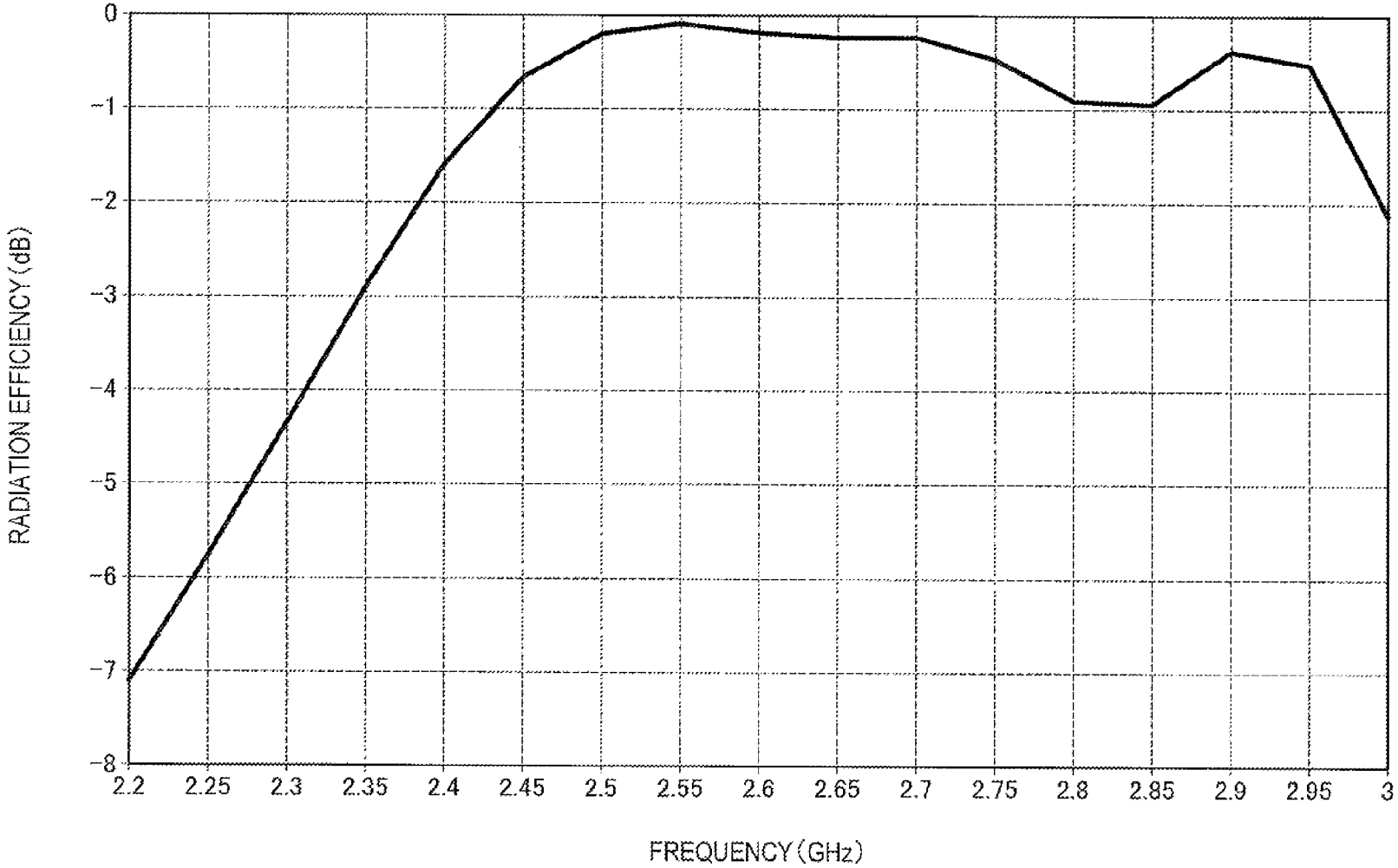
FIG. 13A is a graph showing a simulation result of radiation efficiency in a 2 GHz frequency band in the second embodiment of the present disclosure.
Figure 13B:
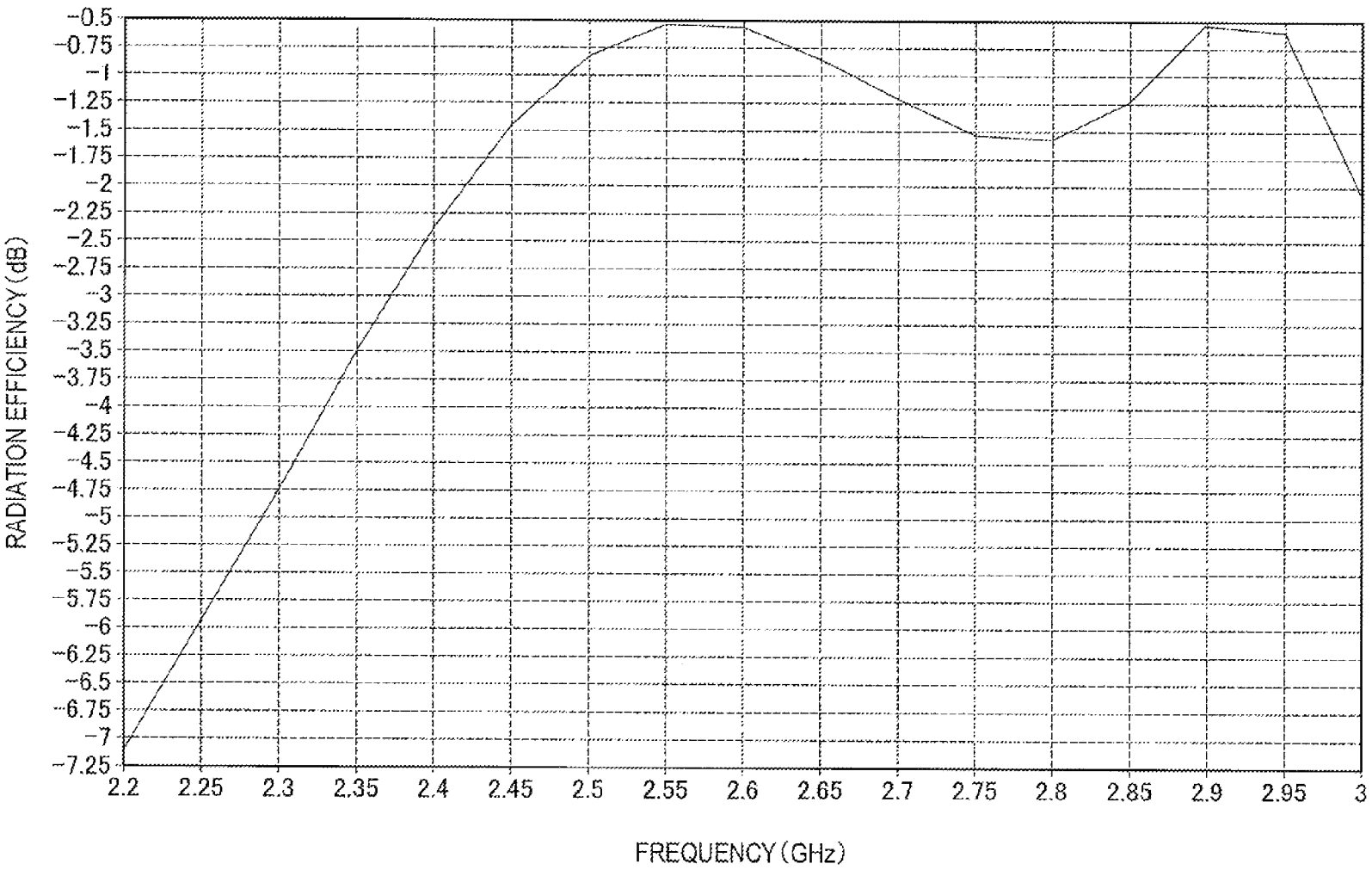
FIG. 13B is a graph showing a simulation result of radiation efficiency in a 2 GHz frequency band in the second embodiment of the present disclosure.

FIG. 13A is a graph showing a simulation result of radiation efficiency in a 2 GHz frequency band (frequency of 2.2 to 3 GHz) in the second embodiment of the present disclosure. FIG. 13B is a graph showing a similar simulation result of the comparative example in which the slit 153 is not provided. According to the result, it can be seen that in a band of 2.2 to 3 GHz, the radiation efficiency has been improved by approximately 0.5 to 1 dB compared with the comparative example. In contrast to the simulation result of the first embodiment illustrated in FIG. 4A, a frequency band, in which the radiation efficiency is high, has extended to a band of 2.7 to 3 GHz, and thus the effect of the parasitic element 254 has been demonstrated.

Figure 14A:
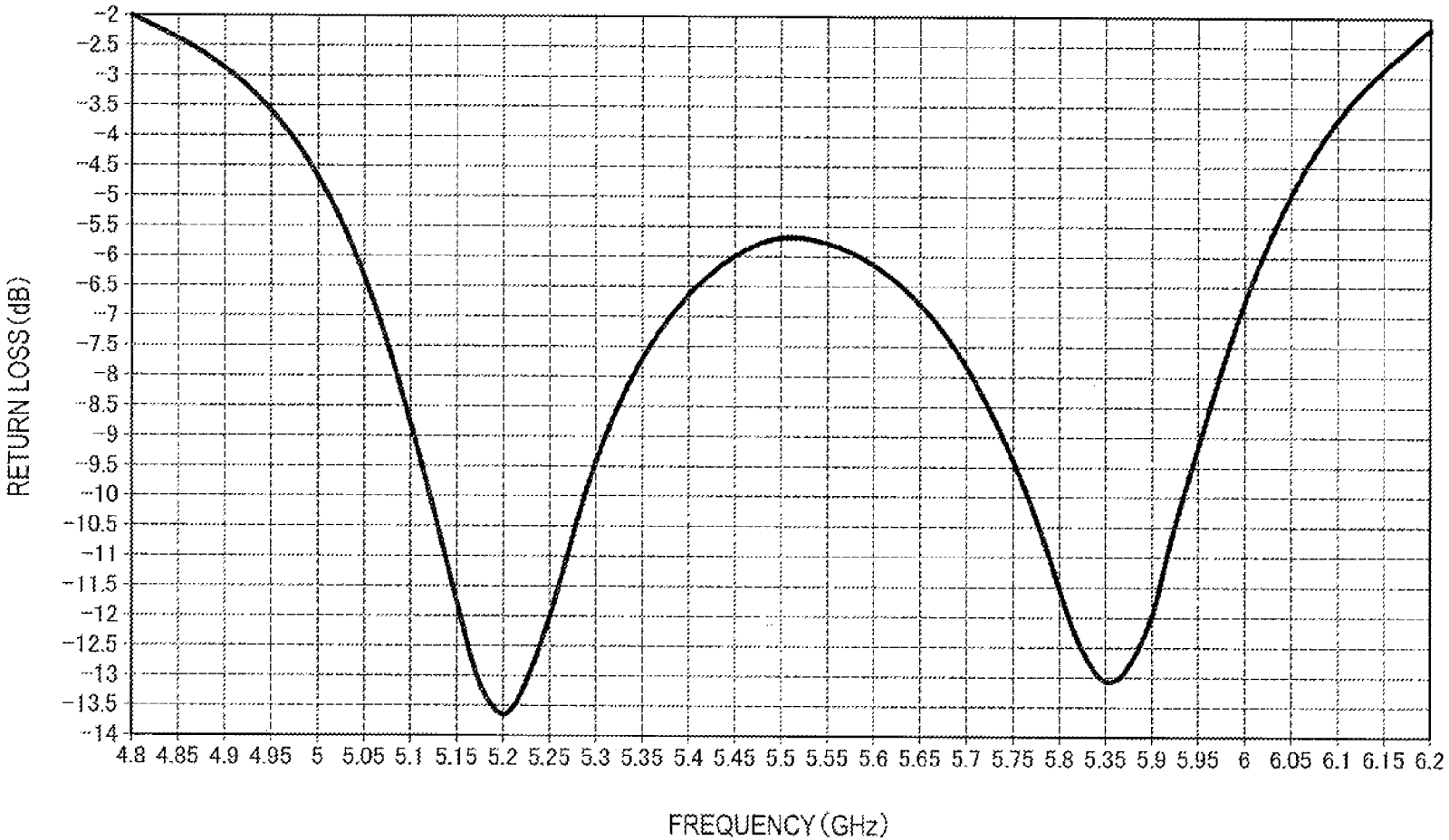
FIG. 14A is a graph showing a simulation result of return loss in a 5 GHz frequency band in the second embodiment of the present disclosure.
Figure 14B:
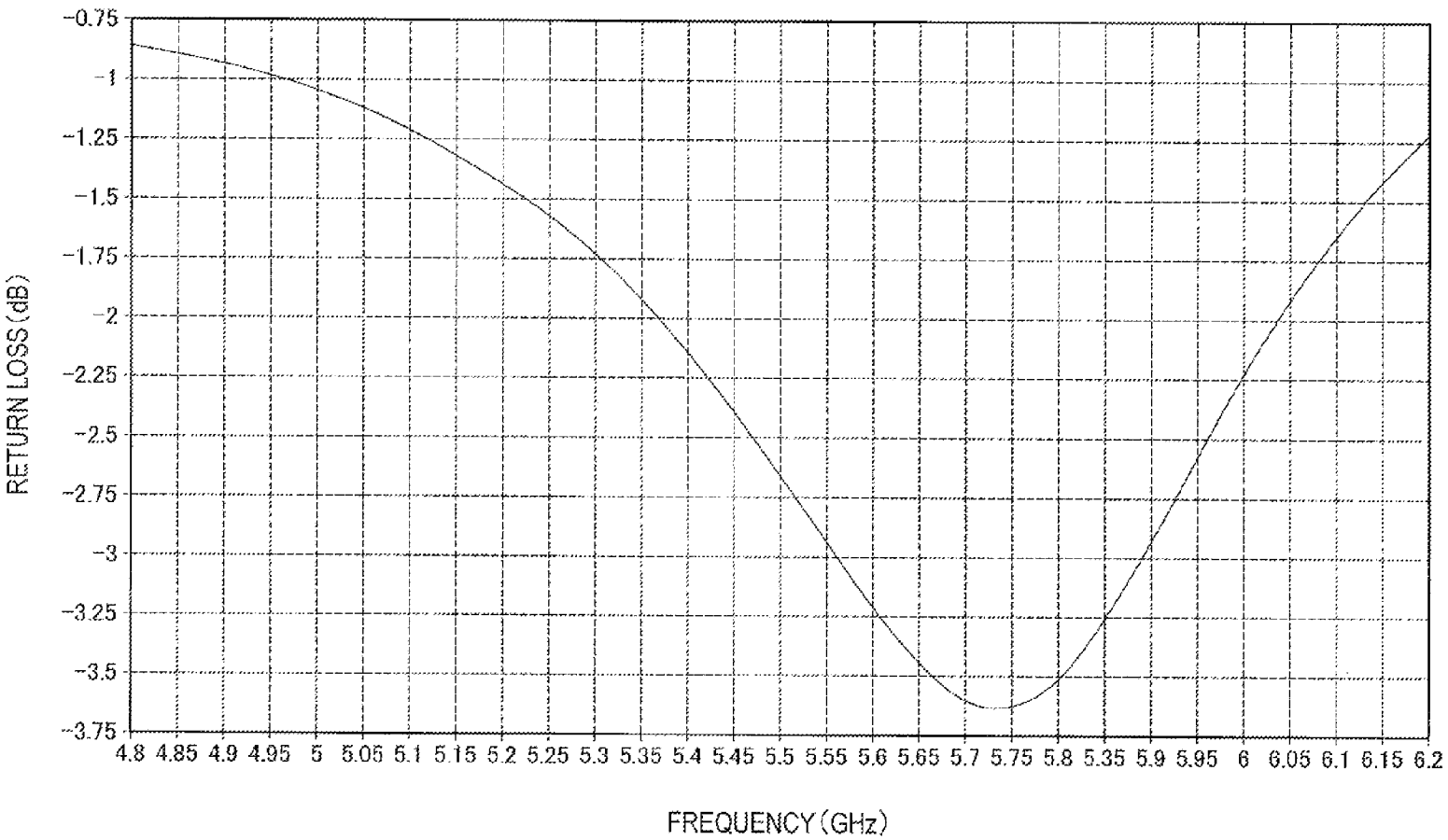
FIG. 14B is a graph showing a simulation result of return loss in a 5 GHz frequency band in the second embodiment of the present disclosure.

FIG. 14A is a graph showing a simulation result of return loss in a 5 GHz frequency band (frequency of 4.8 to 6.2 GHz) in the second embodiment of the present disclosure. FIG. 14B is a graph showing a similar simulation result of the comparative example in which the slit 153 is not provided. According to the result, a new matching point, which is not present in the comparative example, occurred at the frequency of 5.2 GHz. From this result, it can be concluded that the matching characteristic has been improved in a band of 5.15 to 5.85 GHz by providing the slit 153. On the other hand, compared with the simulation result of the first embodiment illustrated in FIG. 5A, there is almost no difference in return loss. From this result, it can be seen that the parasitic element 254 in the present embodiment mainly contributed to broadbandization in a 2 GHz frequency band, and had no effect on the 5 GHz frequency band.

Figure 15A:
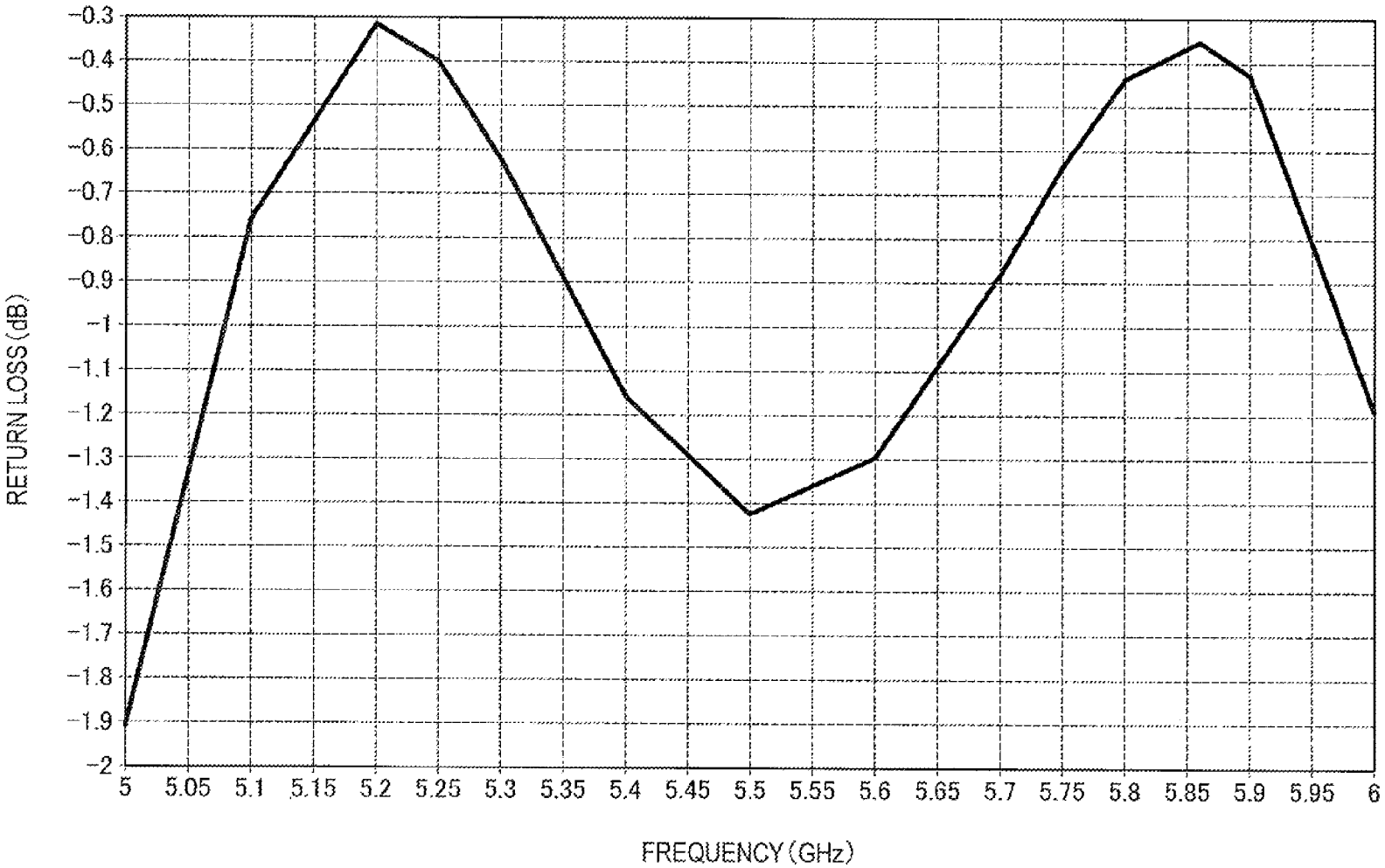
FIG. 15A is a graph showing a simulation result of radiation efficiency in a 5 GHz frequency band in the second embodiment of the present disclosure.
Figure 15B:
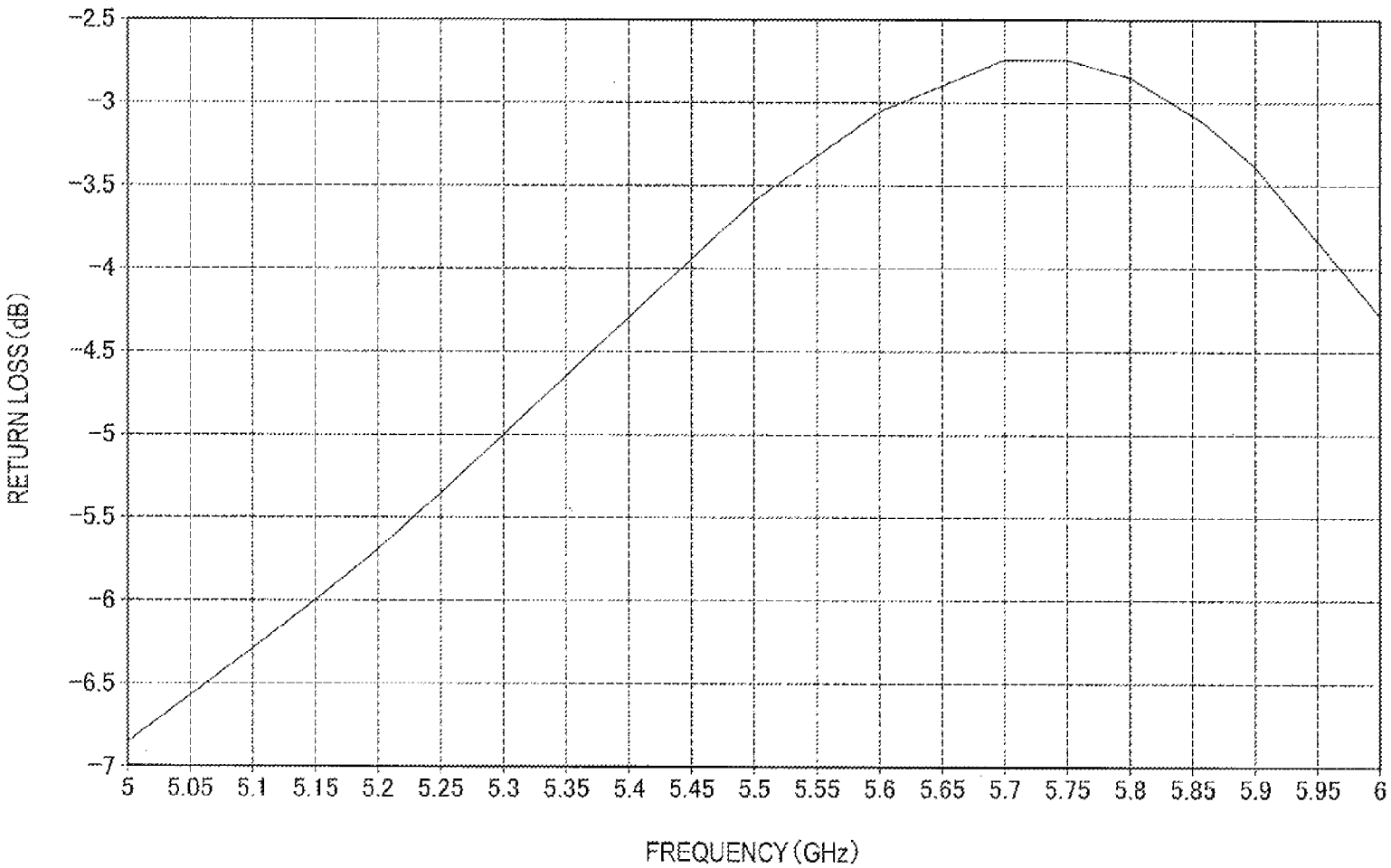
FIG. 15B is a graph showing a simulation result of radiation efficiency in a 5 GHz frequency band in the second embodiment of the present disclosure.

FIG. 15A is a graph showing a simulation result of radiation efficiency in a 5 GHz frequency band (frequency of 5 to 6 GHz) in the second embodiment of the present disclosure. FIG. 15B is a graph showing a similar simulation result of the comparative example in which the slit 153 is not provided. According to the result, it can be seen that the radiation efficiency characteristic was also improved in a band of 5.15 to 5.85 GHz due to the occurrence of the above-mentioned matching point. On the other hand, compared with the simulation result of the first embodiment illustrated in FIG. 6A, there is almost no difference in radiation efficiency. From this result, it can be seen that the parasitic element 254 in the present embodiment mainly contributed to broadbandization in a 2 GHz frequency band, and had no effect on the 5 GHz frequency band.

Figure 16:
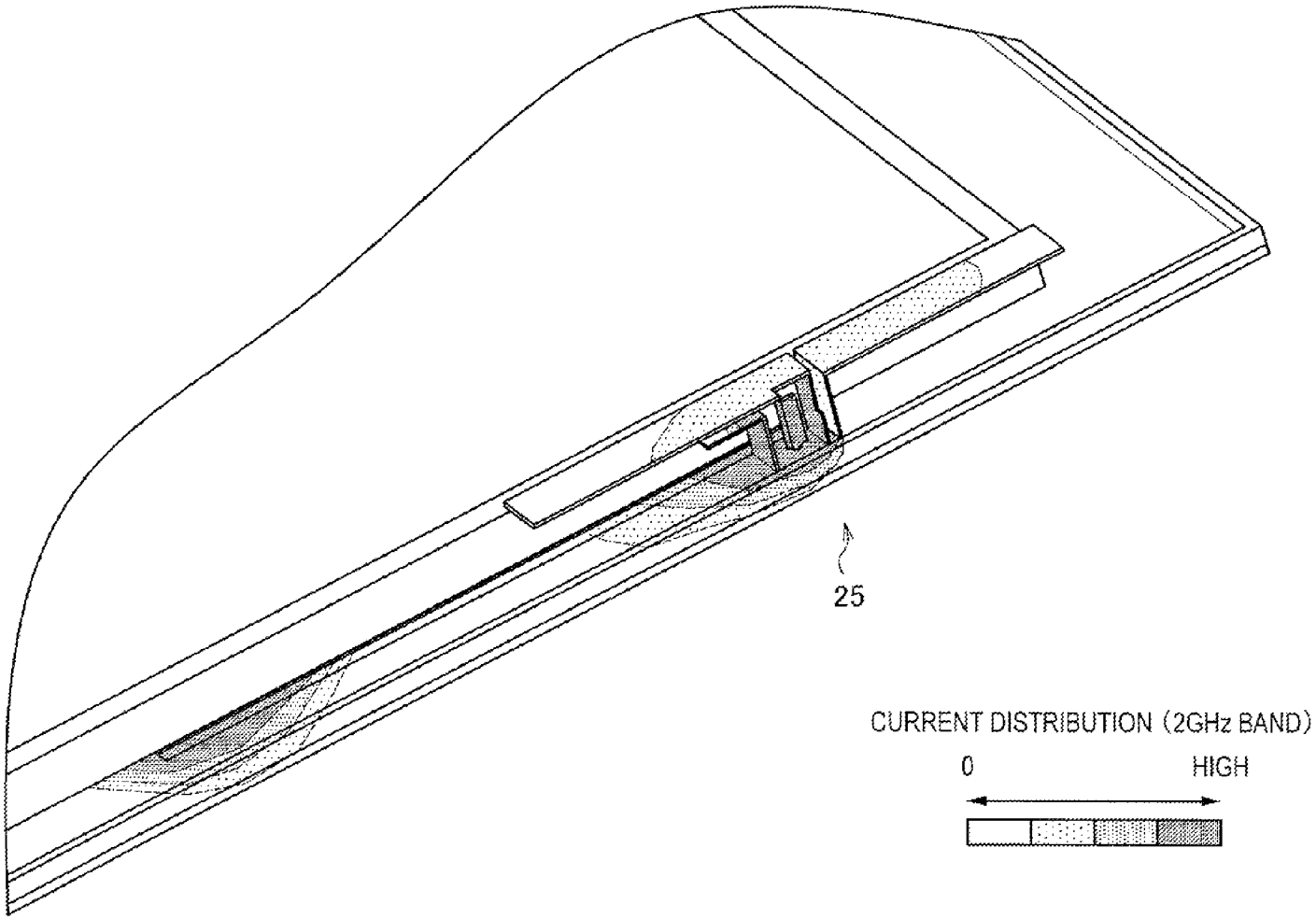
FIG. 16 is an illustration showing a simulation result of average current distribution in a 2 GHz frequency band in the second embodiment of the present disclosure.

FIG. 16 is an illustration showing a simulation result of average current distribution in a 2 GHz frequency band (frequency of 2.7 GHz) in the second embodiment of the present disclosure. According to the result, similarly to the simulation result of the first embodiment illustrated in FIG. 7, it can be seen that the case 11 in the vicinity of the slit 153 was excited and excitation occurred. The wavelength of the excitation occurred in the slit 153 portion of the case 11 is approximately ½ of the length of the slit 153. Such an excitation of the conductor part 11*m* of the case, serving as GND, was not observed in the comparative example in which the slit 153 was not provided, and thus it can be concluded that the excitation is an effect that is achieved by providing the slit 153. According to the above-described result, it can be seen that current has occurred also in the parasitic element 254 and excitation of the parasitic element 254 occurred, which contributed to broadbandization in a 2 GHz frequency band of the antenna 151.

Figure 17:
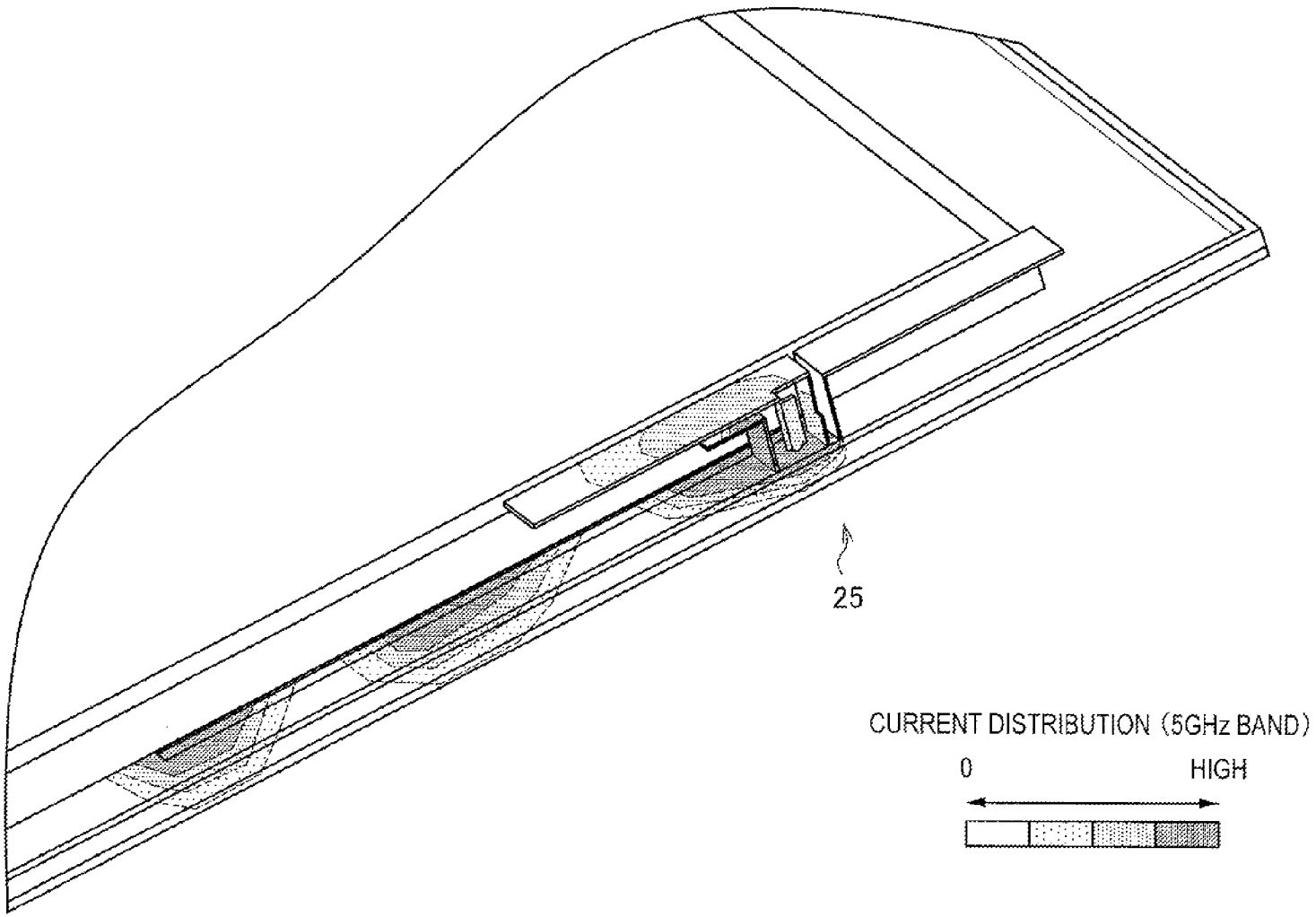
FIG. 17 is an illustration showing a simulation result of average current distribution in a 5 GHz frequency band in the second embodiment of the present disclosure.

FIG. 17 is an illustration showing a simulation result of average current distribution in a 5 GHz frequency band (frequency of 5.25 GHz) in the second embodiment of the present disclosure. According to the result, similarly to the simulation result of the first embodiment illustrated in FIG. 8, it can be seen that the case 11 in the vicinity of the slit 153 was excited and excitation occurred. The wavelength of the excitation occurred in the slit 153 portion of the case 11 is approximately the same as the length of the slit 153. By setting the length of the slit 153 appropriately in this manner, excitation is made to occur in a plurality of desired bands, and thus the radiation characteristic of the antenna 151 can be improved by using the slit 153 portion of the case 11 as a parasitic element. On the other hand, according to the above-described result, it can be seen that no current occurred in the parasitic element 254 and the parasitic element 254 had no effect on the 5 GHz frequency band.

Figure 18:
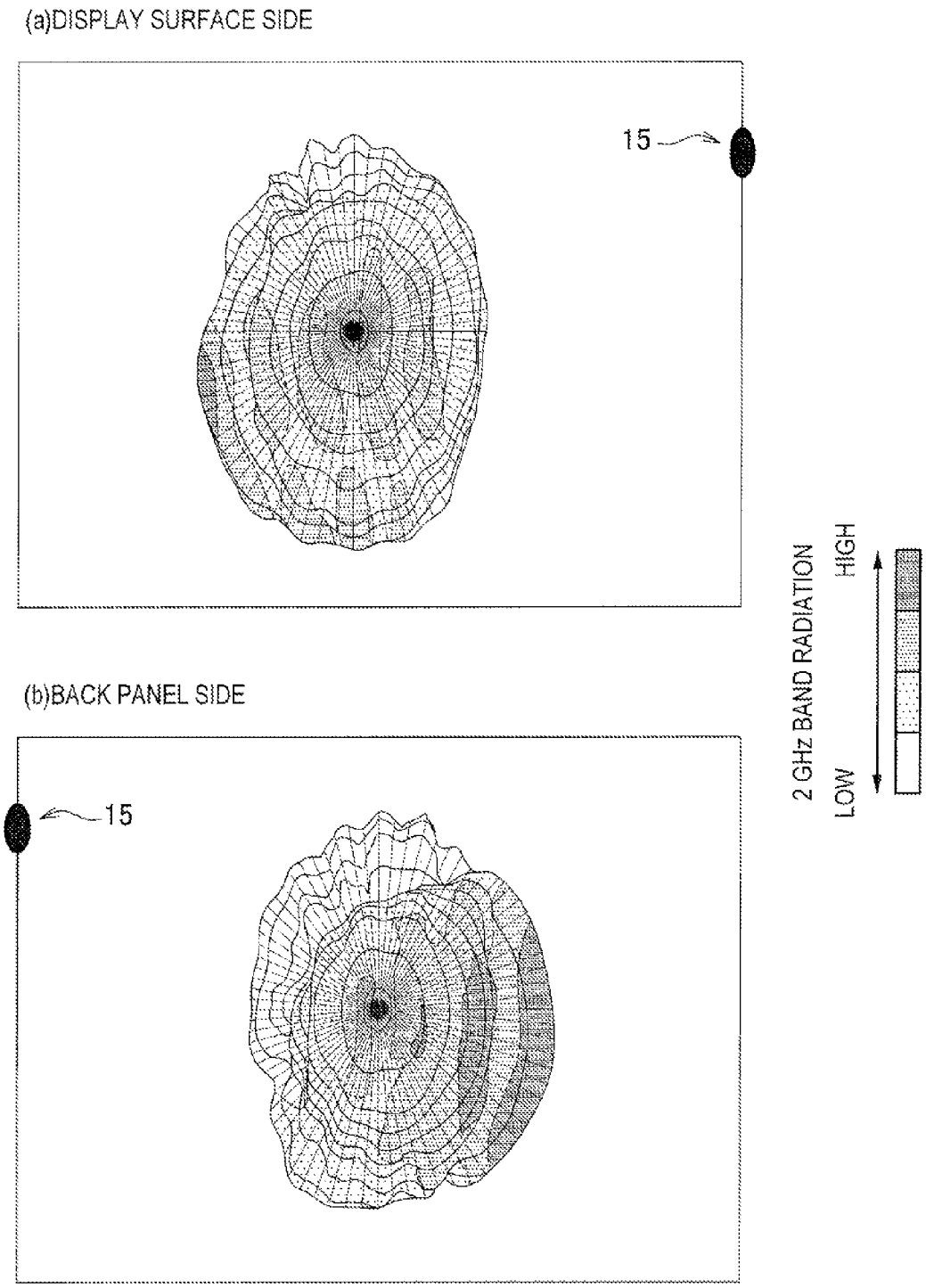
FIG. 18 is an illustration showing a simulation result of radiation pattern in a 2 GHz frequency band in the second embodiment of the present disclosure.

FIG. 18 is an illustration showing a simulation result of radiation pattern in a 2 GHz frequency band (frequency of 2.7 GHz) in the second embodiment of the present disclosure. According to this result, it can be seen that relatively intense radiation occurred each on the display surface side illustrated in (a) and on the back panel side illustrated in (b). Consequently, it can be concluded that in the present embodiment, the radiation from the antenna in the 2 GHz frequency band exhibits nearly non-directional characteristic due to the slit 153 provided.

Figure 19:
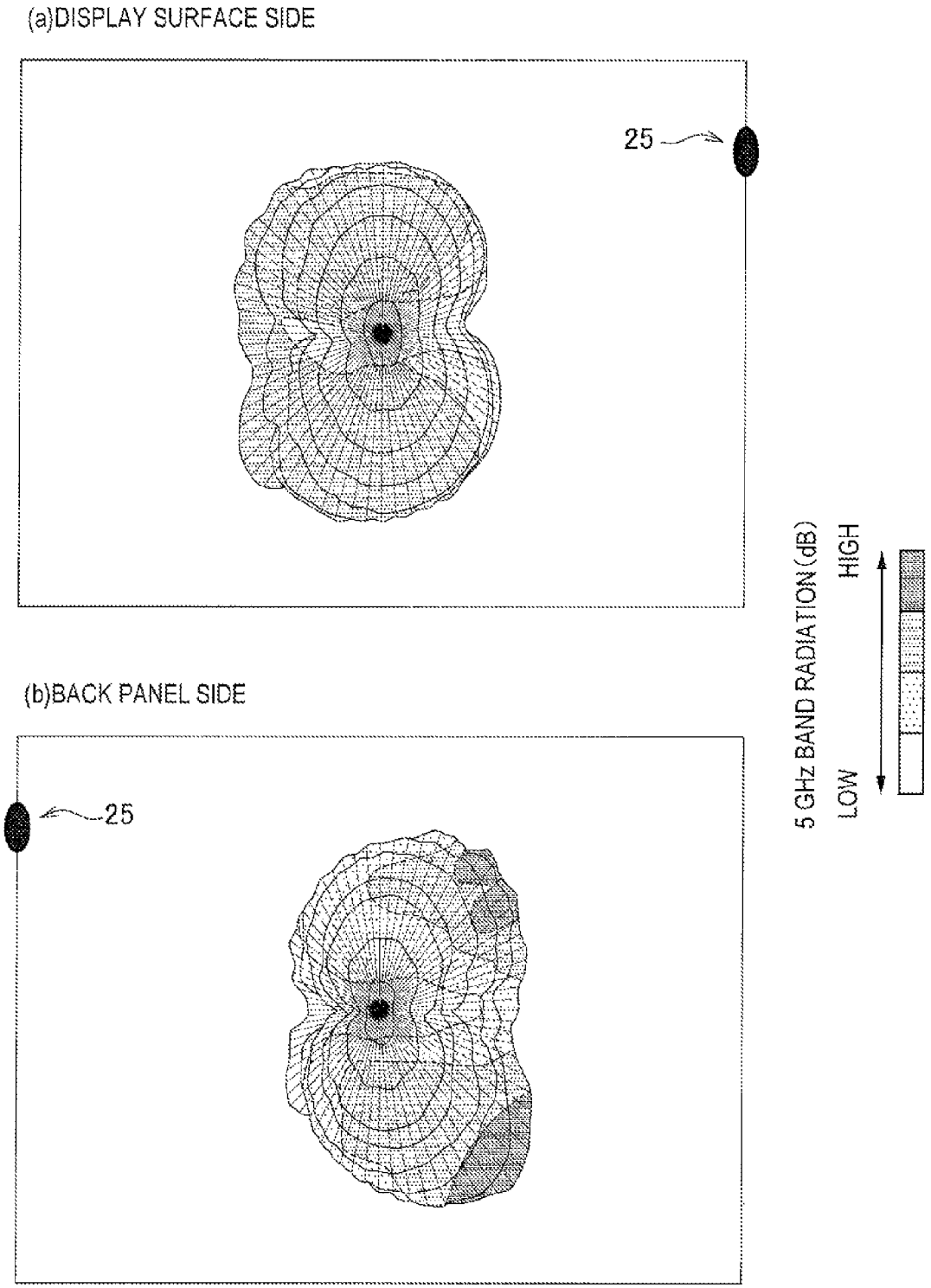
FIG. 19 is an illustration showing a simulation result of radiation pattern in a 5 GHz frequency band in the second embodiment of the present disclosure.

FIG. 19 is an illustration showing a simulation result of radiation pattern in a 5 GHz frequency band (frequency of 5.2 GHz) in the second embodiment of the present disclosure. According to the result, similarly to the case of a frequency band of 2 GHz, it can be seen that relatively intense radiation occurred each on the display surface side illustrated in (a) and on the back panel side illustrated in (b). Consequently, it can be concluded that in the present embodiment, the radiation from the antenna in the 5 GHz frequency band also exhibits nearly non-directional characteristic due to the slit 153 provided.

(Study Related to Slit Length)

Hereinafter, study related to the slit length of the slit 153 in the antenna unit 25 will be described with reference to FIGS. 20 and 21.

Figure 20:
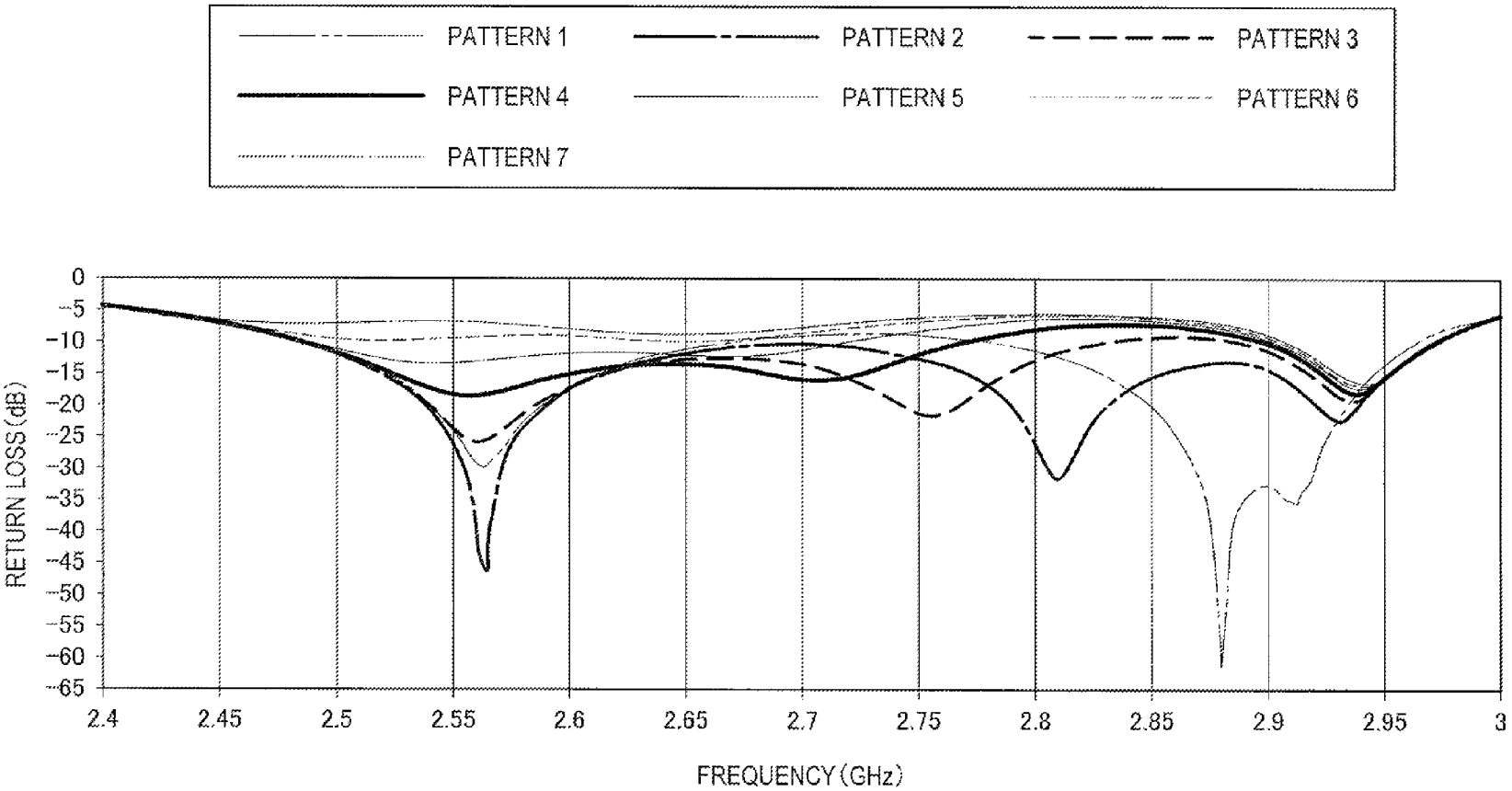
FIG. 20 is a graph showing a simulation result of return loss for each of slit lengths in a 2 GHz frequency band in the second embodiment of the present disclosure.
Figure 21:
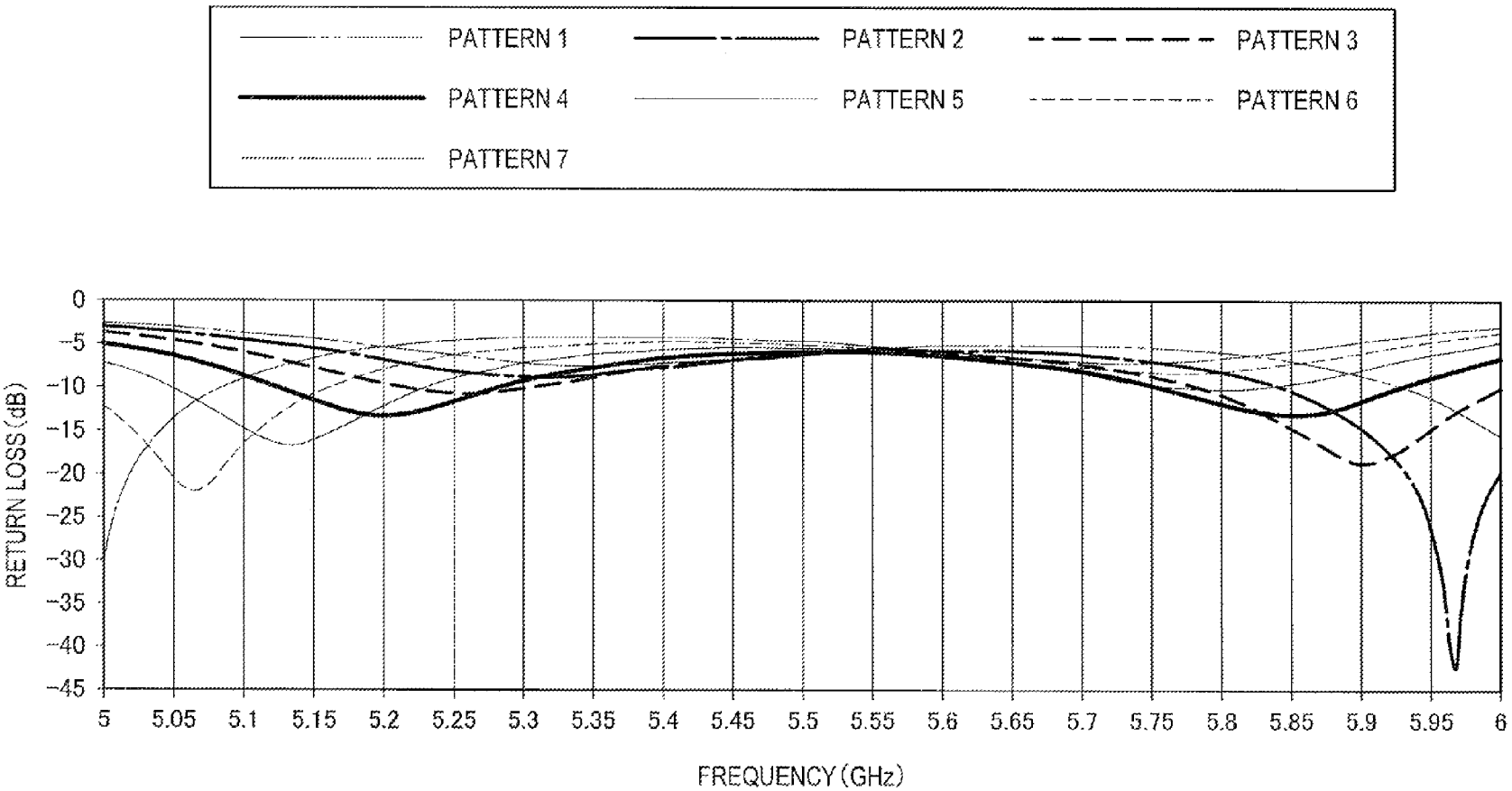
FIG. 21 is a graph showing a simulation result of return loss for each of slit lengths in a 5 GHz frequency band in the second embodiment of the present disclosure.

FIG. 20 is a graph showing a simulation result of return loss for each of slit lengths in a 2 GHz frequency band (frequency of 2.4 to 3 GHz) in the second embodiment of the present disclosure. FIG. 21 is a graph showing a simulation result of return loss for each of the slit lengths in a 5 GHz frequency band (frequency of 5 to 6 GHz) in the second embodiment of the present disclosure.

In the above-mentioned study, the slit length of the slit 153 was changed in a range of 49 to 55 mm, and simulation of return loss was performed for each length. The correspondence between illustrated patterns 1 to 7 and slit lengths is as shown in the following table 1.

TABLE 1

SLIT LENGTH FOR EACH PATTERN

| PATTERN | SLIT LENGTH (mm) |
|---|---|
| 1 | 49 |
| 2 | 50 |
| 3 | 51 |
| 4 | 52 |
| 5 | 53 |
| 6 | 54 |
| 7 | 55 |

Here, in order to change the slit length, the start point of the slit 153 at the position of the short pin 151*c* of the antenna 151 was not changed, but the end point of the slit 153 at the open end side of the antenna element 151*a* was changed. The position of the start point of the slit 153 was separately studied as described below.

As a result of the above study, it was found that the case of pattern 4, that is, the slit length of 52 mm provides the most preferable radiation characteristic of the entire frequency band as a target. More specifically, for example, in pattern 2 and pattern 7, although a lower value of return loss was demonstrated in a partial area, the return loss in pattern 4 provides a lower value in the rest of the partial area. From the viewpoint that antenna characteristic preferably exhibits a relatively high value in a wide band rather than an outstanding high peak in a limited frequency band, the most preferable slit length is the slit length in the case of pattern 4. As described above, the slit length of 52 mm is equivalent to 6/13 of the wavelength of radio waves having a frequency of 2.65 GHz.

(Study Related to Slit Position)

Hereinafter, study related to the position of the slit 153 in the antenna unit 25 will be described with reference to FIGS. 22 and 23.

Figure 22:
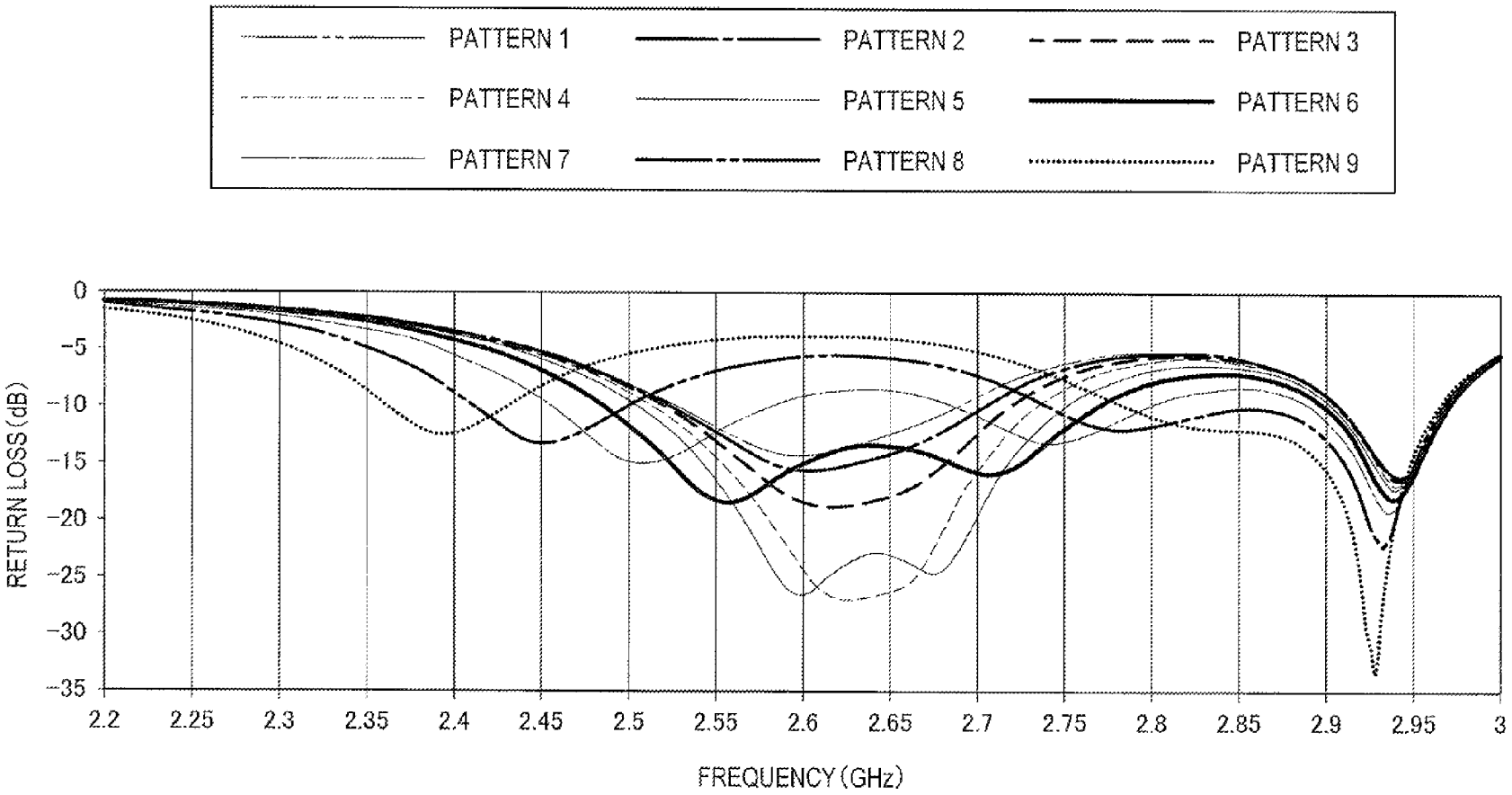
FIG. 22 is a graph showing a simulation result of return loss for each of slit positions in a 2 GHz frequency band in the second embodiment of the present disclosure.
Figure 23:
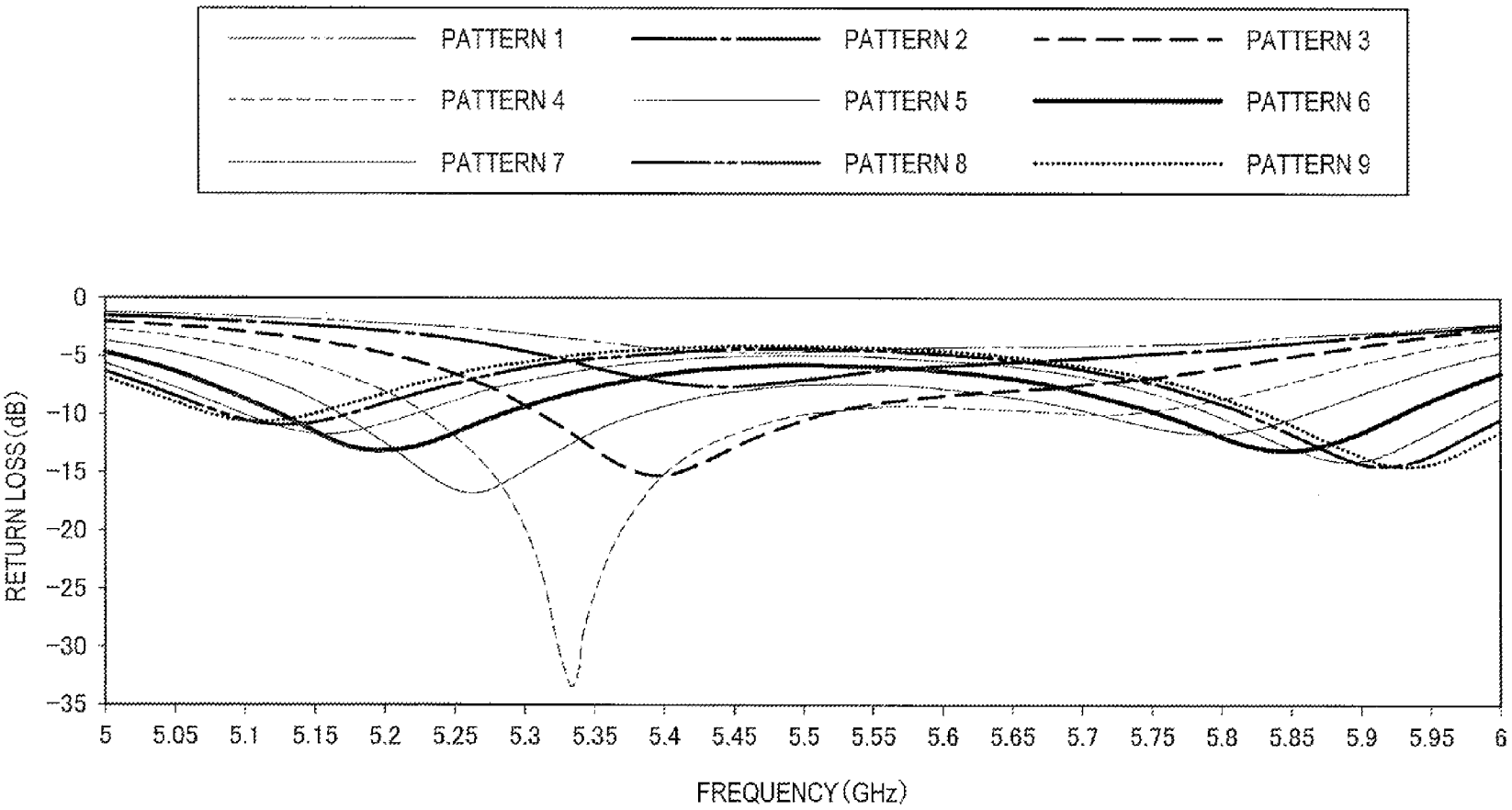
FIG. 23 is a graph showing a simulation result of return loss for each of slit positions in a 5 GHz frequency band in the second embodiment of the present disclosure.

FIG. 22 is a graph showing a simulation result of return loss for each of slit positions in a 2 GHz frequency band (frequency of 2.2 to 3 GHz) in the second embodiment of the present disclosure. FIG. 23 is a graph showing a simulation result of return loss for each of the slit positions in a 5 GHz frequency band (frequency of 5 to 6 GHz) in the second embodiment of the present disclosure.

In the above-mentioned study, the position of the start point of the slit 153 was changed (the magnitude of the change is referred to as a slit start point displacement) in a range of −5 to +3 mm in the direction of the side of the case 11, that is, in the direction in which the slit 153 is extended with the length of the slit 153 fixed, where the position of the short pin 151*c* of the antenna 151 served as a reference (0 mm). For each position, simulation of return loss was performed. The correspondence between illustrated patterns 1 to 9 and slit start point displacements is as shown in the following table 2. When the slit start point displacement has a negative value, the start point of the slit 153 is moved toward the open end side of the antenna element 151*a*, and when the slit start point displacement has a positive value, the start point of the slit 153 is moved to the opposite side.

TABLE 2

SLIT START POINT DISPLACEMENT FOR EACH PATTERN

| PATTERN | SLIT START POINT DISPLACEMENT (mm) |
|---|---|
| 1 | −5 |
| 2 | −4 |
| 3 | −3 |
| 4 | −2 |
| 5 | −1 |
| 6 | 0 |
| 7 | +1 |
| 8 | +2 |
| 9 | +3 |

As a result of the above study, it was found that the case of pattern 6, that is, the start point of the slit 153 at the position of the short pin 151*c* of the antenna 151 provides the most desirable radiation characteristic of the entire frequency band as a target. More specifically, for example, in pattern 4 and pattern 5 (when the start point of the slit 153 is near the power supply pin 151*b*), although a lower value of return loss was demonstrated in a partial area, the return loss in pattern 6 provides a lower value in the rest of the partial area. From the viewpoint that antenna characteristic preferably exhibits a relatively high value in a wide band rather than an outstanding high peak in a limited frequency band, the most preferable slit position is the slit position in the case of pattern 6.

(Study Related to Position of Parasitic Element)

Hereinafter, study related to the position of the parasitic element 152 in the antenna unit 25 will be described with reference to FIGS. 24 and 25.

Figure 24:
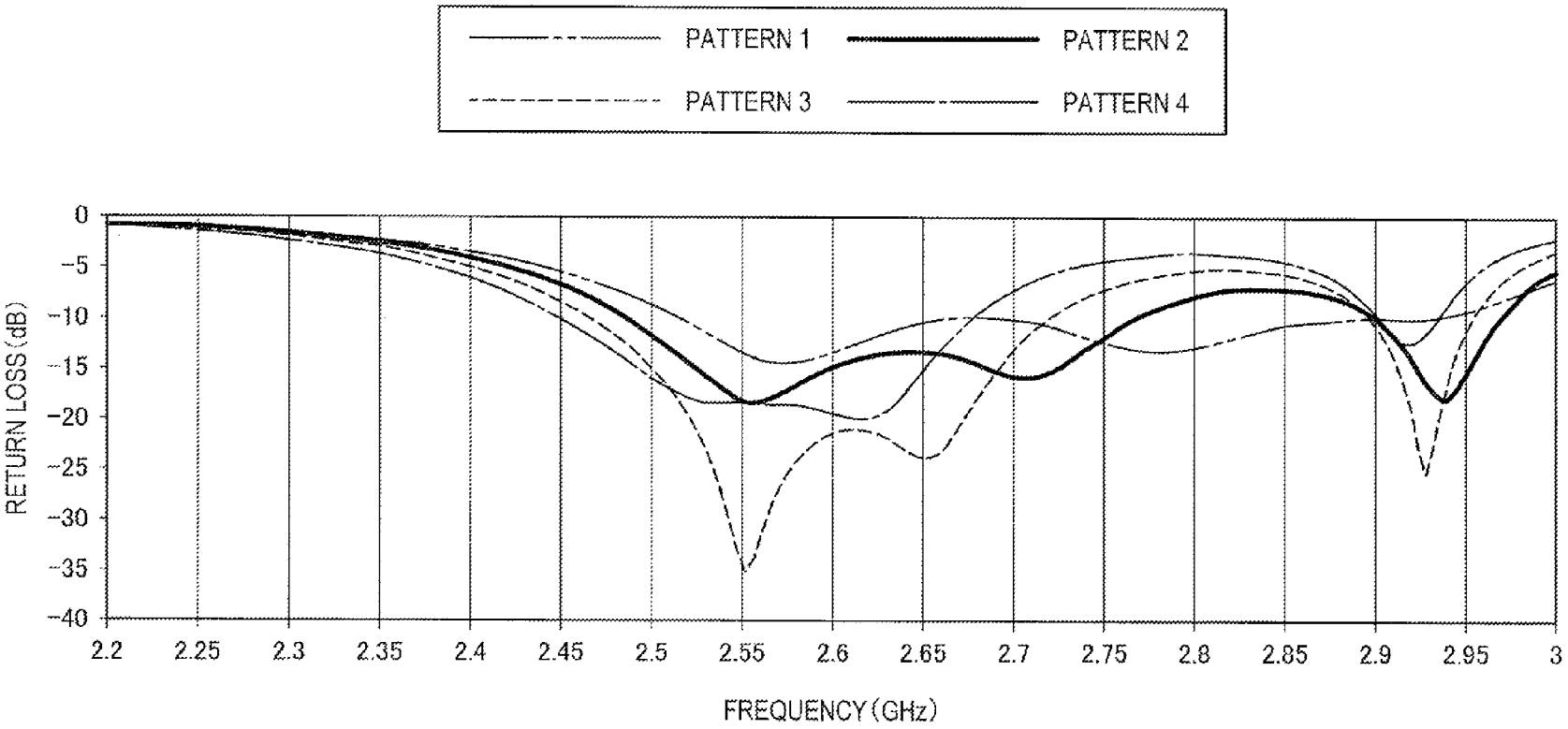
FIG. 24 is a graph showing a simulation result of return loss for each of installation positions of a parasitic element in a 2 GHz frequency band in the second embodiment of the present disclosure.
Figure 25:
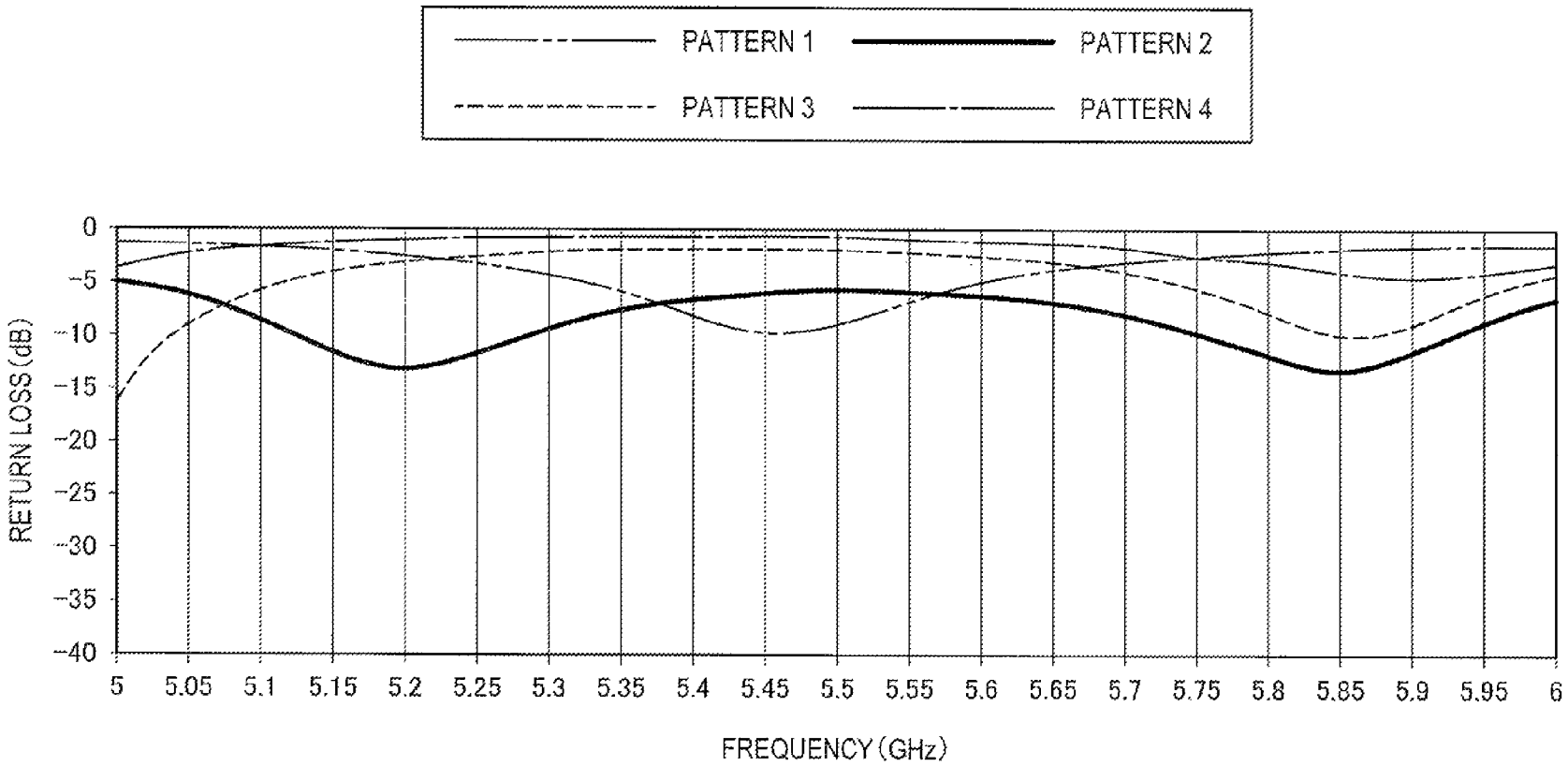
FIG. 25 is a graph showing a simulation result of return loss for each of installation positions of a parasitic element in a 5 GHz frequency band in the second embodiment of the present disclosure.

FIG. 24 is a graph showing a simulation result of return loss for each of installation positions of the parasitic element in a 2 GHz frequency band (frequency of 2.2 to 3 GHz) in the second embodiment of the present disclosure. FIG. 25 is a graph showing a simulation result of return loss for each of the installation positions of the parasitic element in a 5 GHz frequency band (frequency of 5 to 6 GHz) in the second embodiment of the present disclosure.

In the above-mentioned study, the installation position of the parasitic element 152 was changed (the magnitude of the change is referred to as a parasitic element installation position displacement) in a range of −2 to +1 mm in the direction of the side of the case 11, that is, in the direction in which the parasitic element 152 is extended, where the position, which is apart from the start point of the slit 153 by 1/12 of the length of the slit 153, served as a reference (0 mm). For each position, simulation of return loss was performed. The correspondence between illustrated patterns 1 to 4 and parasitic element installation position displacements is as shown in the following table 3. When the parasitic element installation position displacement has a negative value, the parasitic element 152 is moved away from the power supply pin 151*b* of the antenna 151, and when the parasitic element installation position displacement has a positive value, the parasitic element 152 is moved toward the power supply pin 151*b* of the antenna 151.

TABLE 3

| PARASITIC ELEMENT INSTALLATION POSITION DISPLACEMENT FOR EACH PATTERN | |
|---|---|
| PATTERN | PARASITIC ELEMENT INSTALLATION POSITION DISPLACEMENT (mm) |
| 1 | +1 |
| 2 | 0 |
| 3 | −1 |
| 4 | −2 |

As a result of the above study, it was found that the case of pattern 2, that is, the installation position of the parasitic element 152 at the position apart from the start point of the slit 153 by 1/12 of the length of the slit 153 provides the most desirable radiation characteristic of the entire frequency band as a target. More specifically, for example, in pattern 3 (when the parasitic element 152 is moved away from the power supply pin 152), a lower value of return loss is demonstrated in a partial area. However, from the viewpoint that antenna characteristic preferably exhibits a relatively high value in a wide band rather than an outstanding high peak in a limited frequency band, the most preferable installation position of the parasitic element 152 is the position in the case of pattern 2.

3. Third Embodiment

Hereinafter, a third embodiment of the present disclosure will be described. Although the third embodiment of the present disclosure is different from the above-described second embodiment in that the antenna unit is provided with a plurality of slits, except this, the third embodiment has a configuration in common with the second embodiment. Thus, a detailed description for the configuration in common will be omitted.

(Configuration of Antenna Section)

Here, the configuration of an antenna unit of an electronic device according to a third embodiment of the present disclosure will be described with reference to FIG. 26.

Figure 26:
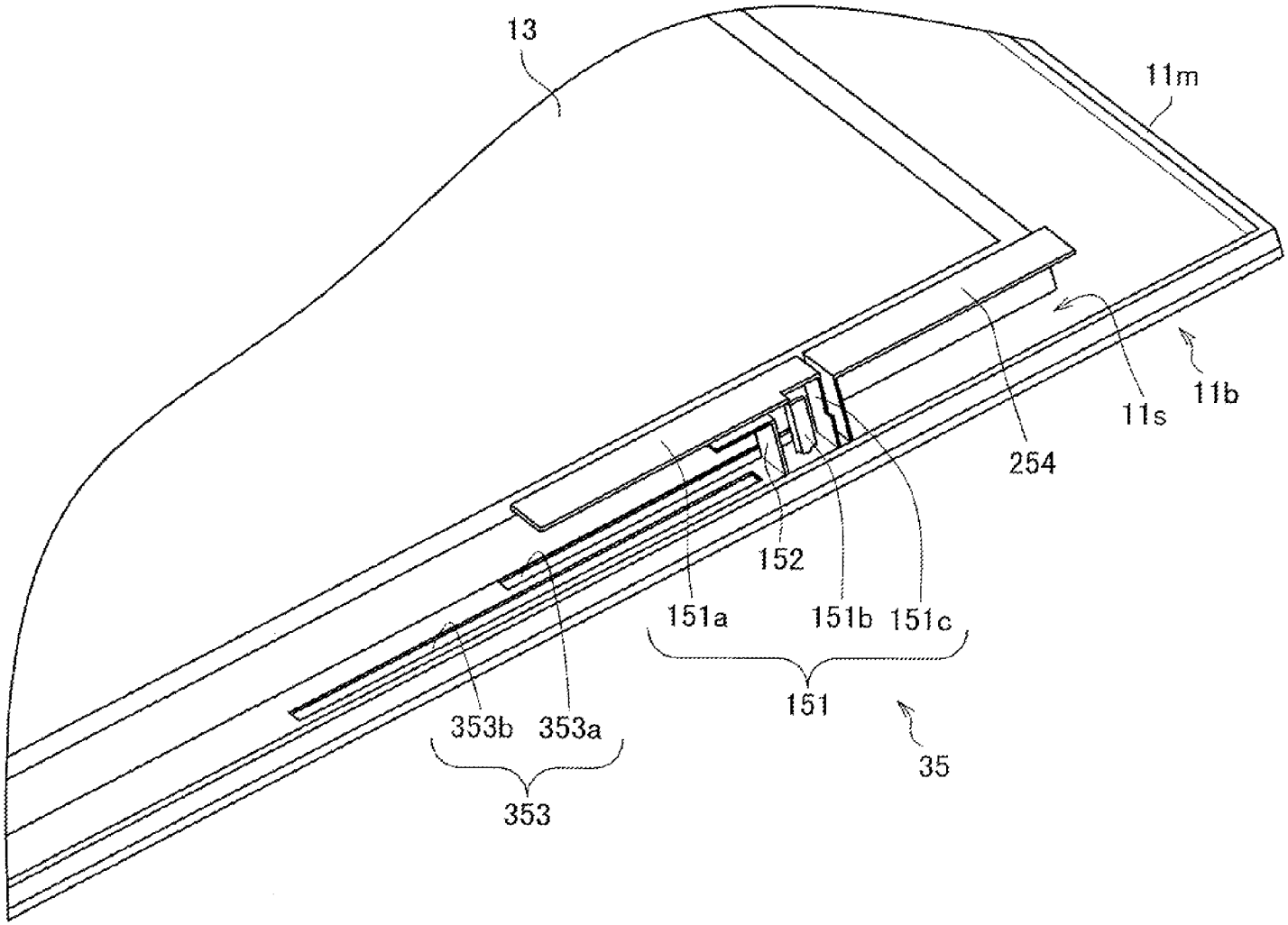
FIG. 26 is an illustration showing an antenna unit of an electronic device according to a third embodiment of the present disclosure.

FIG. 26 is an illustration showing the antenna unit of the electronic device according to the third embodiment of the present disclosure. As illustrated, an antenna unit 35 of the notebook PC 10 includes the antenna 151, the parasitic element 152, the parasitic element 254, and a slit 353. Because the antenna 151, the parasitic element 152, and the parasitic element 254 each have the same configuration as that of the above-described second embodiment, a detailed description thereof will be omitted.

The slit 353 includes two slits 353*a*, 353*b*. Each of the slits 353*a*, 353*b* is a slit that is formed in an area of the case surface 11*s* in parallel with the antenna element 151*a* and extends in the same direction as the antenna element 151*a*. Although the slit 353 includes the two slits 353*a*, 353*b* in the present embodiment, three or more slits may be included in other embodiments.

Here, the slit 353*a* extends from a start point in the direction toward the open end of the antenna element 151*a*, the start point being the position of the short pin 151*c* of the antenna 151, that is, the position of the fixed end of the antenna element 151*a*. In the illustrated example, the end point of the slit 353*a* is located at approximately the same position as the open end of the antenna element 151*a*. However, without being limited to this, the positional relationship between the end point of the slit 353*a* and the open end of the antenna element 151*a* is arbitrary. The slit 353*a* extends adjacent to the long side of the antenna element 151*a* when viewed from the above in FIG. 26.

On the other hand, the slit 353*b* from a start point in the direction toward the open end of the antenna element 151*a*, the start point being near the grounding position of the parasitic element 152 provided under the antenna element 151*a*. The end point of the slit 353*b* is ahead of the open end of the antenna element 151*a* in the illustrated example. However, without being limited to this, the positional relationship between the end point of the slit 353*b* and the open end of the antenna element 151*a* is arbitrary. The slit 353*b* extends such that the slit 353*b* is hidden halfway behind the antenna element 151*a* when viewed from the above in FIG. 26.

The slits 353*a*, 353*b* described above each function as a parasitic element of the antenna 151. That is, in response to the radiation from the antenna element 151*a*, the slit 353*a*, 353*b* portions of the case surface 11*s* are each excited and excitation occurs. This enables the radiation characteristic of the antenna 151 to be improved.

The lengths of the slits 353*a*, 353*b* are preferably, for example, 4/9 to 1/2 of wavelengths corresponding to the respective frequencies of the excitation of the slit 353*a*, 353*b* portions of the case surface 11*s*. This is because appropriate lengths of the slits 353*a*, 353*b* for exciting the slit 353*a*, 353*b* portions of the case surface 11*s* are made shorter than 1/2 of wavelengths corresponding to the frequencies of the excitation due to the shapes of the slits 353*a*, 353*b*, the shape of the case surface 11*s* in the periphery of the slits 353*a*, 353*b*, or whether or not dielectric materials are disposed for the slits 353*a*, 353*b*.

Here, the frequency of the excitation of the slit 353*a* portion of the case surface 11*s* may be, for example, the frequency of the second harmonic for the frequency of the excitation of the slit 353*b* portion. It is preferable that these frequencies of the excitation be close to the frequency of the radiation from the antenna 151 and the second harmonic for the frequency. The frequencies of the excitation, however, are not necessarily the same as those. As an example of setting, the length of the slit 353*a* may be set to 23.5 mm and the length of the slit 353*b* may be set to 52 mm. In this case, the length of the slit 353*a* is equivalent to 4/9 of the wavelength of radio waves having a frequency of 5.725 GHz. On the other hand, the length of the slit 353*b* is equivalent to 6/13 of the wavelength of radio wave having a frequency of 2.65 GHz.

4. Summary

So far, the first to third embodiments of the present disclosure have been described. A summary for these embodiments is given below.

In the first embodiment, the slit 153 extending in a direction parallel to the antenna element 151*a* is provided for the antenna 151, which is provided to be grounded to the case surface 11*s* of the conductor part 11*m* of the case 11 of the notebook PC 10 which is an electronic device. The slit 153 portion of the case surface 11*s* serves as a parasitic element, thereby enabling broadbandization of the antenna 151 and improving the radiation to the back panel side of the case 11.

In the above-described first embodiment, the parasitic element 152 is further provided that extends along the antenna element 151*a* between the case 11 and the antenna element 151*a*. The parasitic element 152 is excited, for example, with a frequency close to the second harmonic of the frequency of the radiation of the slit 153 and contributes to dual band operation of the antenna 151. It is to be noted that the parasitic element 152 produces an additional effect, and so may not necessarily be provided.

In addition to the above-described configuration, in the second embodiment, the parasitic element 254 is further provided that extends in a direction away from the antenna 151. The parasitic element 254 contributes to, for example, broadbandization of the antenna 151. In the second embodiment, although the parasitic element 254 is provided in addition to the parasitic element 152, the parasitic element 152 and the parasitic element 254 each produce an effect independently as mentioned above, and thus a configuration may be adopted in which the parasitic element 254 is provided without providing the parasitic element 152.

In the third embodiment, the slit 353 includes a plurality of slits 353*a*, 353*b*. One of the plurality of slits 353*a*, 353*b* may be regarded as a slit and the other may be regarded as an additional slit. The lengths of the plurality of slits 353*a*, 353*b* can be set so as to cause excitation in respective different frequency bands.

In the third embodiment, although the parasitic element 152 and the parasitic element 254 are provided, each of the parasitic element 152 and the parasitic element 254 produces an additional effect as mentioned above, and thus the slit 353 including the plurality of slits 353*a*, 353*b* can be provided without providing one of or both of the parasitic elements.

The antenna in an electronic device according to any embodiment of the present disclosure, including each of the above-described embodiments favorably achieves, for example, broadbandization and dual band operation, and thus includes certain types which are particularly suitable for operation in dual band wireless LAN (Local Area Network) and WiMAX (Worldwide Interoperability for Microwave Access).

So far, the preferred embodiments of the present disclosure have been described in detail with reference to the accompanying drawings. However, the technical scope of the present disclosure is not limited to the above examples. It is apparent that in the scope of technical idea described in the appended claims, various alterations and modifications may occur to persons of ordinary skill in the technical field of the present disclosure, and it should be understood that they will naturally come under the technical scope of the present disclosure.

Additionally, the present technology may also be configured as below.

(1)

An electronic device including:

a case including a conductor part; and an antenna that is provided on a case surface on an inner side of the conductor part and includes an antenna element extending in a first direction parallel to the case surface, the antenna element being grounded to the case surface, wherein a slit extending in the first direction is formed in an area of the case surface, the area being parallel to the antenna element.

(2)

The electronic device according to (1), wherein the area of the case surface, in which the slit is formed, operates as a parasitic element of the antenna, the parasitic element causing a first excitation.

(3)

The electronic device according to (2), wherein the slit has a length equal to 4/9 to ½ of a wavelength corresponding to a frequency of the first excitation.

(4)

The electronic device according to any one of (1) to (3), wherein the antenna includes a first parasitic element that is disposed between the antenna element and the case surface and extends in the first direction.

(5)

The electronic device according to (4), wherein one end of the antenna element is a fixed end which is provided with a short pin, another end of the antenna element is an open end, and a grounding point at which the first parasitic element is grounded to the case surface is apart from an end point on a side of the fixed end of the slit by 1/12 of a length of the slit inwardly of the slit.

(6)

The electronic device according to any one of (1) to (5), wherein the antenna includes a second parasitic element that is disposed subsequent to the antenna element in the first direction.

(7)

The electronic device according to any one of (1) to (6), wherein one end of the antenna element is a fixed end that is provided with a short pin, another end of the antenna element is an open end, and the slit extends from the fixed end as a start point in a direction toward the open end.

(8)

The electronic device according to any one of (1) to (7), wherein an additional slit extending in the first direction is formed in the area of the case surface, the area being parallel to the antenna element.

(9)

The electronic device according to (8), wherein the area of the case surface, in which the slit is formed, operates as a parasitic element of the antenna, the parasitic element causing a first excitation, and the area of the case surface, in which the additional slit is formed, operates as a parasitic element of the antenna, the parasitic element causing a second excitation.

(10)

The electronic device according to (9), wherein the second excitation is an excitation with a frequency of a second harmonic for a frequency of the first excitation.

(11)

The electronic device according to any one of (1) to (10), wherein the antenna is an inverted-F antenna.

(12)

The electronic device according to any one of (1) to (11), wherein the antenna operates in dual band wireless LAN and WiMAX.

REFERENCE SIGNS LIST

10 notebook PC (electronic device)
11 case
13 display
15, 25, 35 antenna unit
151 antenna
151*a* antenna element
151*b* power supply pin
151*c* short pin
152 parasitic element
153, 353 slit
254 parasitic element

The invention claimed is:

1. An electronic device, comprising:

a case that includes a conductor part;

an antenna that is provided on a case surface on an inner side of the conductor part and includes an antenna element that extends in a first direction parallel to the case surface, the antenna element is grounded to the case surface, wherein one end of the antenna element is a fixed end that is provided with a short pin, and another end of the antenna element is an open end; and a slit that extends in the first direction is formed in an area of the case surface, the area is parallel to the antenna element, wherein the slit extends from the fixed end as a start point in a direction toward the open end, wherein the antenna includes a first parasitic element disposed subsequent to the fixed end of the antenna element, and extends in a direction opposite to the first direction, wherein the antenna includes a second parasitic element disposed between the antenna element and the case surface, and extends in the first direction, and wherein an additional slit that extends in the first direction, from a fixed end of the second parasitic element, is formed in the area of the case surface.

2. The electronic device according to claim 1, wherein the area of the case surface, in which the slit is formed, operates as a parasitic element of the antenna, and the parasitic element causes a first excitation.

3. The electronic device according to claim 2, wherein the slit has a length equal to 4/9 to 1/2 of a wavelength that corresponds to a frequency of the first excitation.

4. The electronic device according to claim 1, wherein a grounding point at which the second parasitic element is grounded to the case surface is apart from an end point on a side of the fixed end of the slit by 1/12 of a length of the slit inwardly of the slit.

5. The electronic device according to claim 1, wherein the area of the case surface is parallel to the antenna element.

6. The electronic device according to claim 5, wherein the area of the case surface, in which the slit is formed, operates as a parasitic element of the antenna, and the parasitic element causes a first excitation, and the area of the case surface, in which the additional slit is formed, operates as a parasitic element of the antenna, and the parasitic element causes a second excitation.

7. The electronic device according to claim 6, wherein the second excitation is an excitation with a frequency of a second harmonic for a frequency of the first excitation.

8. The electronic device according to claim 1, wherein the antenna is an inverted-F antenna.

9. The electronic device according to claim 1, wherein the antenna operates in dual band wireless LAN and WiMAX.

10. The electronic device according to claim 1, wherein a shape of the first parasitic element is an inverted-L shape.

* * * * *